US010160096B2

(12) United States Patent
Watanabe

(10) Patent No.: US 10,160,096 B2
(45) Date of Patent: Dec. 25, 2018

(54) GRINDING WHEEL AND METHOD FOR MANUFACTURING GRINDING WHEEL

(71) Applicant: JTEKT CORPORATION, Osaka-shi (JP)

(72) Inventor: Akira Watanabe, Chiryu (JP)

(73) Assignee: JTEKT CORPORATION, Osaka-shi (JP)

( * ) Notice: Subject to any disclaimer, the term of this patent is extended or adjusted under 35 U.S.C. 154(b) by 44 days.

(21) Appl. No.: 15/523,035

(22) PCT Filed: Oct. 30, 2015

(86) PCT No.: PCT/JP2015/080711
§ 371 (c)(1),
(2) Date: Apr. 28, 2017

(87) PCT Pub. No.: WO2016/068283
PCT Pub. Date: May 6, 2016

(65) Prior Publication Data

US 2017/0348828 A1 Dec. 7, 2017

(30) Foreign Application Priority Data

Oct. 31, 2014 (JP) ..... 2014-222200
Feb. 13, 2015 (JP) ..... 2015-026043

(51) Int. Cl.
*B24D 5/06* (2006.01)
*B24D 5/14* (2006.01)
*B24D 18/00* (2006.01)

(52) U.S. Cl.
CPC ..... *B24D 5/06* (2013.01); *B24D 5/14* (2013.01); *B24D 18/0009* (2013.01)

(58) Field of Classification Search
CPC ..... B24D 5/06; B24D 5/14; B24D 18/0009
(Continued)

(56) References Cited

U.S. PATENT DOCUMENTS 1,877,541 A * 9/1932 Tone ..... B24D 5/06 451/544
2,084,513 A * 6/1937 Tone ..... B24D 5/06 451/542

(Continued)

FOREIGN PATENT DOCUMENTS

CN 1449893 A 10/2003
CN 202097676 U 1/2012

(Continued)

OTHER PUBLICATIONS

International Search Report dated Jan. 19, 2016 in PCT/JP2015/080711 filed Oct. 30, 2015.

(Continued)

*Primary Examiner* — George Nguyen
(74) *Attorney, Agent, or Firm* — Oblon, McClelland, Maier & Neustadt, L.L.P.

(57) ABSTRACT

A grinding wheel includes a disc-like member and a grinding layer disposed on an outer peripheral surface of the disc-like member. The grinding layer includes a plurality of circumferentially-divided grinding chips which are divided in a circumferential direction. Each of the circumferentially-divided grinding chips is formed by arranging a first grinding chip and a second grinding chip in the axis direction, the first grinding chip and the second grinding chip having different properties. A boundary portion between the first grinding chip and the second grinding chip of at least three circumferentially-divided grinding chips continuously arranged in the circumferential direction are arranged toward a predetermined direction in the axis direction in the order in which the circumferentially-divided grinding chips are arranged.

12 Claims, 13 Drawing Sheets

(58) Field of Classification Search
USPC ..... 451/542
See application file for complete search history.

(56) References Cited

U.S. PATENT DOCUMENTS

| | | | | | |
|---|---|---|---|---|---|
| 3,324,607 | A * | 6/1967 | Niemiec | B24D 5/06 | 451/488 |
| 3,802,130 | A * | 4/1974 | Lindenbeck | B24D 5/14 | 451/544 |
| 4,131,436 | A * | 12/1978 | Wiand | B24D 5/14 | 51/295 |
| 4,196,547 | A * | 4/1980 | Keske | B24B 33/08 | 451/28 |
| 5,853,319 | A * | 12/1998 | Meyer | B24D 5/14 | 451/548 |
| 2002/0068518 | A1* | 6/2002 | Cesena | B24D 3/06 | 451/541 |
| 2010/0317267 | A1* | 12/2010 | Soma | B24D 5/06 | 451/548 |
| 2014/0302757 | A1* | 10/2014 | Inamori | B24B 53/12 | 451/443 |

FOREIGN PATENT DOCUMENTS

| | | | |
|---|---|---|---|
| CN | 203031480 | U | 7/2013 |
| JP | 55-37123 | U | 3/1980 |
| JP | 58-70868 | U | 5/1983 |
| JP | 8-252772 | A | 10/1996 |
| JP | 11-88640 | A | 7/1999 |
| JP | 2002-537136 | A | 11/2002 |
| JP | 2007-237367 | | 9/2007 |

OTHER PUBLICATIONS

Chinese Office Action dated Aug. 28, 2018 in Chinese Application No. 201580058675.4; with English translation, 17 pages.

* cited by examiner

GRINDING WHEEL AND METHOD FOR MANUFACTURING GRINDING WHEEL

TECHNICAL FIELD

An aspect of the present invention relates to a grinding wheel and a method for manufacturing the grinding wheel.

BACKGROUND ART

Conventionally, for example, a grinding stone has been available that grinds the journal, the crank pin or the like of a vehicular crank shaft (see Patent Document 1 shown below). On the grinding stone disclosed in Patent Document 1, two kinds of grinding layers having different properties are provided in a state of being divided in chips on the outer peripheral surface of a disc-like member forming the grinding wheel. Specifically, on the angular portions at both ends of the outer peripheral surface of the disc-like member in the direction of the rotation axis, since a high grinding resistance is caused at the time of grinding, a grinding layer that is formed of abrasive grains with a large grain diameter and resistant to wear is provided. Moreover, on the cylindrical portion between the angular portions at both ends of the outer peripheral surface, since no high grinding resistance is caused, a grinding layer that is formed of abrasive grains having a small grain diameter and being prone to wear and where a high finishing accuracy is expected is provided. However, in the above, since the grinding layer that is resistant to wear and the grinding layer that is prone to wear adjoin in the axial direction and grinding work is performed at the same time, the degree of wear is different between the grinding layers, so that a level difference is caused at the boundary portions. For this reason, there is a possibility that this level difference is transferred to the workpiece to deteriorate the finishing accuracy.

Accordingly, on the grinding stone of Patent Document 1, the boundary portions in the axial direction formed of the two kinds of grinding chips are not provided with a continuous straight line form as shown in FIG. 6 in the circumferential direction of the outer peripheral surface but are arranged in a so-called staggered form where they are staggered one by one as shown in FIG. 3. This suppresses the occurrence of a large level difference at the boundary portions between the grinding layer that is resistant to wear and the grinding layer that is prone to wear, which suppresses the occurrence of a level difference transferred to the workpiece.

RELATED ART DOCUMENTS

Patent Documents

Patent Document 1: JP-A-H11-188640

SUMMARY OF THE INVENTION

Problem to be Solved by the Invention

However, on the above-described grinding stone, the boundary portions are only staggered one by one in the circumferential direction of the outer peripheral surface. For this reason, it is difficult to sufficiently suppress the occurrence of a level difference due to the wear at the boundary portions between the grinding layer that is resistant to wear and the grinding layer that is prone to wear.

An aspect of the present invention has been made in view of the above-described problem, and an object thereof is to provide a grinding wheel and a method for manufacturing a grinding wheel in which two kinds of grinding layers have different properties are arranged in an axis direction and which can grind a workpiece having different shapes of target grinding portions with excellent finishing accuracy.

Means for Solving the Problem

A grinding wheel according to an aspect of the present invention is a grinding wheel including: a disc-like member; and a grinding layer disposed on an outer peripheral surface of the disc-like member, wherein the grinding layer includes a plurality of circumferentially-divided grinding chips which are divided in a circumferential direction of the disc-like member, wherein each of the circumferentially-divided grinding chips is formed by arranging a first grinding chip and a second grinding chip in an axis direction of the grinding wheel, the first grinding chip and the second grinding chip having different properties, and wherein a shape of a boundary portion between the first grinding chip and the second grinding chip is a shape which connects different positions in the axis direction.

Thereby, the axis direction boundary portions of the at least three circumferentially-divided grinding chips are continuously arranged with a large width in the axis direction in the circumferential direction of the outer peripheral surface compared with the conventional art where the two boundary portions are always arranged so as to be staggered in the axial direction in the circumferential direction. For this reason, the level difference due to the wear between the first grinding chip and the second grinding chip caused because of the difference in properties can be made gentler than the level difference due to the wear between the two kinds of grinding layers caused because of the difference in properties in the conventional art, so that the finishing accuracy of the workpiece can be made excellent.

A method for manufacturing a grinding wheel according to another aspect of the present invention is a method for manufacturing the above-described grinding wheel, the method for manufacturing the grinding wheel, including: forming the grinding layer by arranging the first and second grinding chips provided in each of the plurality of circumferentially-divided grinding chips on the outer peripheral surface of the disc-like member. With the manufacturing method, it is possible to manufacture the grinding wheel which can obtain the advantages similar to the above.

A grinding wheel according to yet another aspect of the present invention is a grinding wheel including: a disc-like member; and a grinding layer disposed on an outer peripheral surface of the disc-like member, wherein the grinding layer includes a plurality of circumferentially-divided grinding chips divided in a circumferential direction, wherein each of the plurality of circumferentially-divided grinding chips is formed by arranging a first grinding chip and a second grinding chip in an axis direction, the first grinding chip and the second grinding chip having different properties, wherein a boundary portion between the first grinding chip and the second grinding chip of each of the plurality of circumferentially-divided grinding chips is defined as an axis direction boundary portion, and wherein the axis direction boundary portions of at least three of the plurality of circumferentially-divided grinding chips continuously arranged in the circumferential direction are arranged toward a predetermined direction in the axis direction in an order of the at least three circumferentially-divided grinding chips continuously arranged in the circumferential direction.

According to the above-described aspect, in areas in the axis direction where the boundary portions of the circumferentially-divided grinding chips are present, the first grinding chips and the second grinding chips are present in mixture at a predetermined ratio, and when viewed in the axis direction of the grinding wheel, the ratio of the mixture is changed. For this reason, when the grinding wheel processes the workpiece, the size of the wear caused in the areas of the boundary portions in the axis direction is a size between the size of the wear caused on the individual first grinding chips and the size of the wear caused on the individual second grinding chips. Thereby, in the product of the present aspect, in the areas of the boundary portions in the axis direction, the level difference caused between the first grinding chips and the second grinding chips is gentle compared with the level difference caused when the first grinding chips and the second grinding chips are arranged under a condition where there is hardly any width of the boundary portions in the axial direction, so that the finishing accuracy of the workpiece is excellent.

MODE FOR CARRYING OUT THE INVENTION

First Embodiment (Structure of the Grinding Wheel)

Figure 1A:
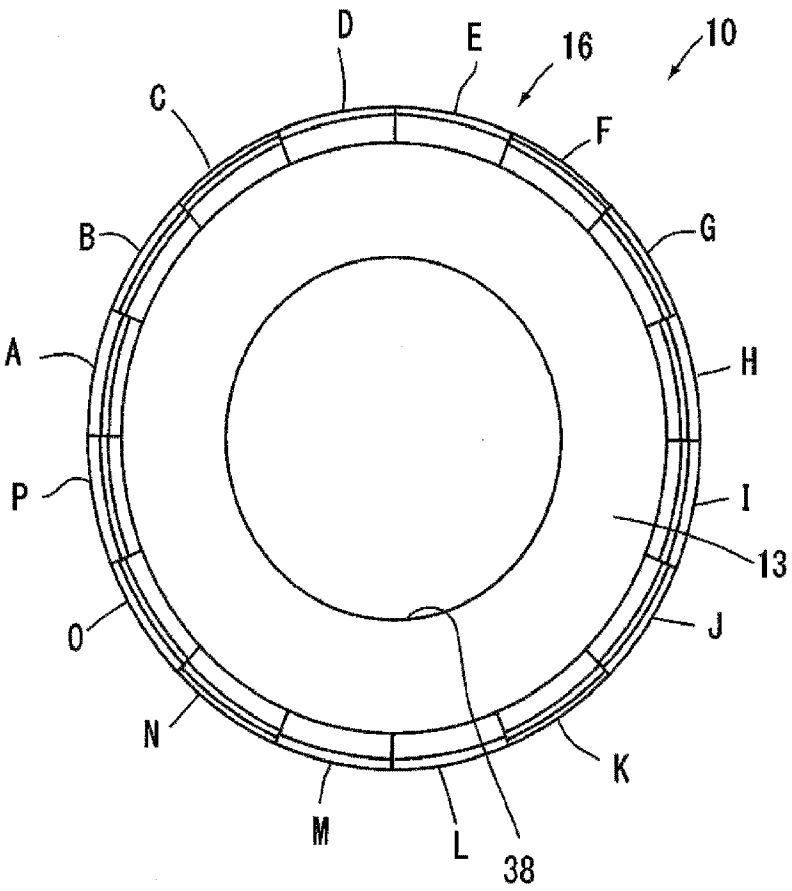
FIG. 1A is a front view showing a grinding wheel according to a first embodiment.

Hereinafter, a first embodiment of the grinding wheel of the present invention will be described based on the drawings. As shown in FIG. 1A, a grinding wheel 10 is provided with a disc-like base 13 (corresponding to an example of the disc-like member) and a grinding layer 16 disposed on the outer peripheral surface of the disc-like base 13. The disc-like base 13 is molded of a metal such as iron or aluminum, a resin, or the like. The disc-like base 13 is rotated around the rotation axis of the grinding wheel 10 (hereinafter, referred to merely as around the axis). Hereinafter, when the term axis is used without any special explanation, it means the rotation axis of the grinding wheel 10. The grinding layer 16 is provided with a plurality of (sixteen in the present embodiment) circumferentially-divided grinding chips A to P equally divided in the circumferential direction. The grinding wheel 10 is a form grinding wheel the object to be grounded of which is a concave groove provided on the outer periphery such as the crank pin or the journal of a vehicular crank shaft.

Figure 1B:
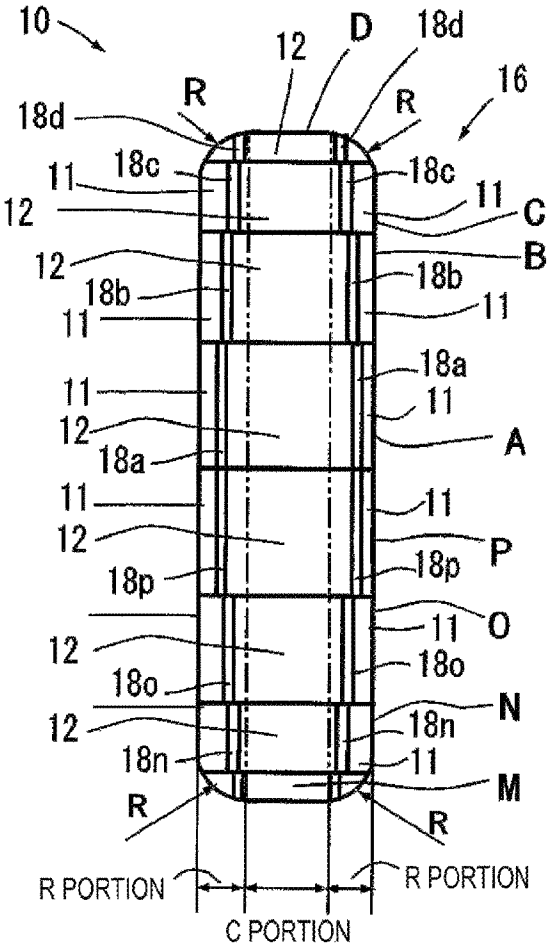
FIG. 1B is a side view of the grinding wheel of FIG. 1A.
Figure 2:
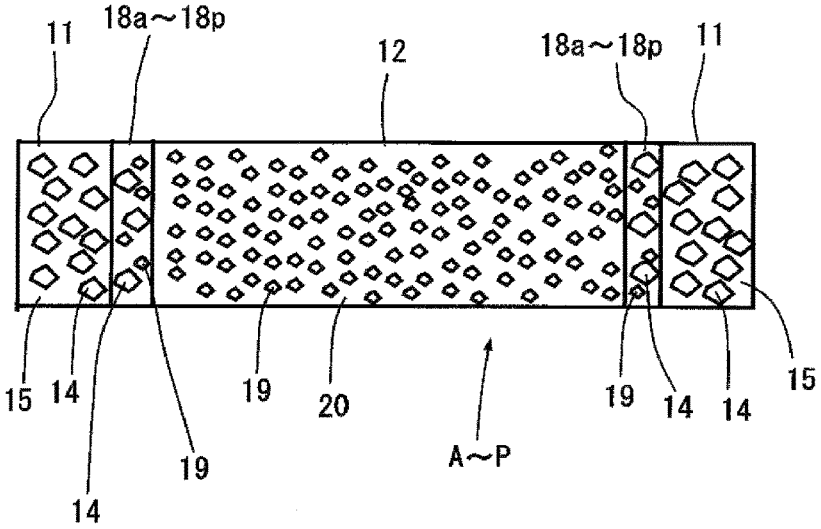
FIG. 2 is a schematic view showing the surface condition of circumferentially-divided grinding chips A to P.

The circumferentially-divided grinding chips A to P are arranged in alphabetical order in the circumferential direction on the outer peripheral surface of the disc-like base 13. As shown in FIG. 1B and FIG. 2, the circumferentially-divided grinding chips A to P are each provided with two first grinding chips 11, one second grinding chip 12 and two mixture portions. The first grinding chips 11, the second grinding chips 12 and the mixture portions are grindstones having different properties. While the two mixture portions possessed by each of the circumferentially-divided grinding chips A to P have a similar shape and property, for the purpose of distinction, the mixture portions possessed by the circumferentially-divided grinding chips A to P will be called mixture portions 18*a* to 18*p*, respectively, in the description. That is, the circumferentially-divided grinding chip A is provided with the mixture portions 18*a* and 18*a*, and the circumferentially-divided grinding chip B is provided with the mixture portions 18*b* and 18*b*. Likewise, the circumferentially-divided grinding chips C to P are provided with the mixture portions 18*c* and 18*c* to 18*p* and 18*p*, respectively. The two first grinding chips 11, the one second grinding chip 12 and the mixture portions 18*a* to 18*p* are arranged in a state of being arranged in a preset order in the axis direction on each of the circumferentially-divided grinding chips A to P.

Regarding the above-described preset order, the circumferentially-divided grinding chip A will be described as a representative. For the circumferentially-divided grinding chip A, the preset order is the order of the first grinding chip 11, the mixture portion 18*a*, the second grinding chip 12, the mixture portion 18*a* and the first grinding chip 11. That is, as shown in FIG. 1B, the first grinding chips 11 are disposed on the angular portions (R portions) at both sides formed in an R shape in the axis direction of the outer peripheral surface of the disc-like base 13. The second grinding chip 12 is disposed on the cylindrical portion (C portion) as the central portion between the first grinding chips 11 in the axis direction of the outer peripheral surface. The mixture portions 18*a* and 18*a* are disposed between the first grinding chips 11 and the second grinding chip 12, respectively. The same applies to the circumferentially-divided grinding chips B to P. Although described later in detail, on each of the circumferentially-divided grinding chips A to P, the boundary portions between the first grinding chips 11 and the second grinding chip 12 are defined as axis direction boundary portions, and in the present embodiment, the mixture portions 18*a* to 18*p* correspond to the axis direction boundary portions.

Figure 3:
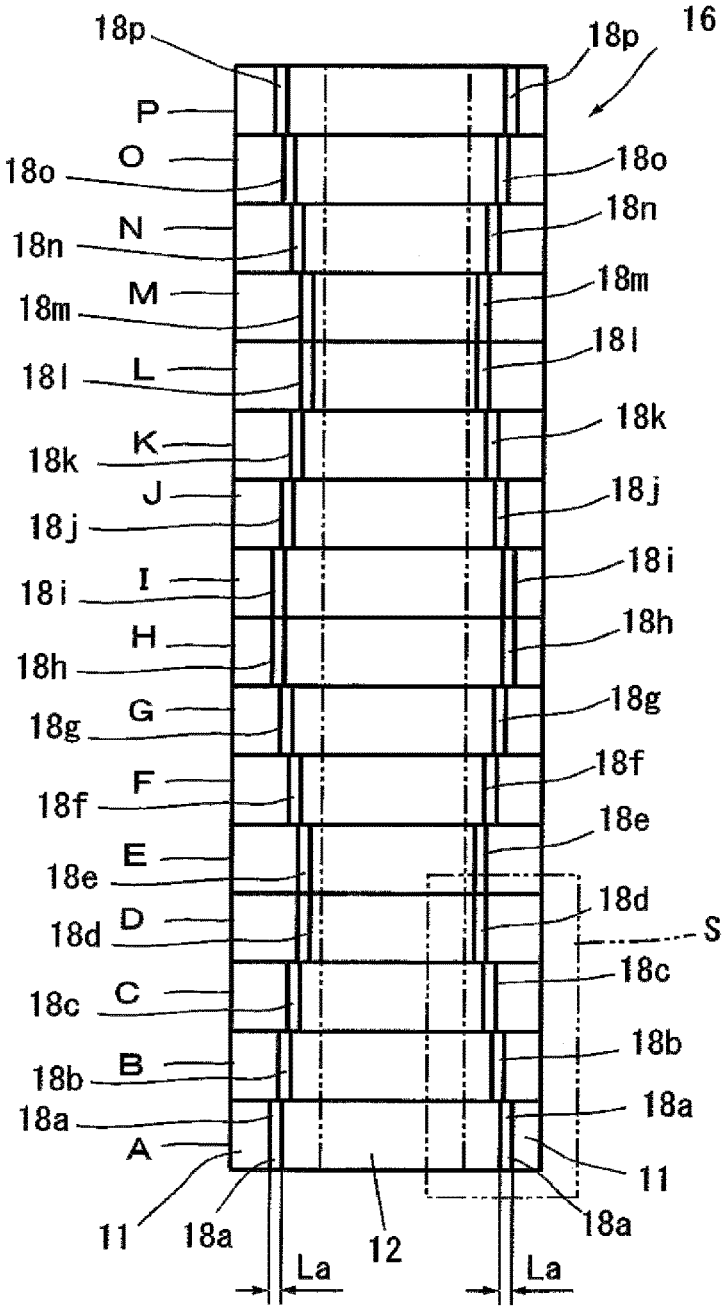
FIG. 3 is a development view of the surroundings of the axis of a grinding layer.

As shown in FIG. 2, the first grinding chips 11 are formed by binding superabrasive grains 14 (corresponding to an example of the abrasive grain) such as CBN or diamond by a binding material 15. FIG. 2 is a schematic view showing the surface condition of the circumferentially-divided grinding chips A to P. The first grinding chips 11 are, as an example, formed by binding CBN abrasive grains with a grain size of #80 by the vitrified binding material 15 with a concentration ratio of 200 in a rectangular shape, for example, with a thickness of 4 to 8 mm. Therefore, the first grinding chips 11 are grinding chips being large in the grain diameter of the grindstone so that they are for rough grinding and being high in hardness and comparatively resistant to wear. Although described later in detail, as shown in FIG. 3, the width in the axis direction is different among the four first grinding chips 11 possessed by, of the circumferentially-divided grinding chips A to P, the four circumferentially-divided grinding chips A to D, E to H, I to L and M to P adjoining in the circumferential direction.

As shown in FIG. 2, the second grinding chips 12 are formed by binding superabrasive grains 19 (corresponding to the abrasive grain) such as CBN or diamond by a binding material 20. The binding material 20 is a binding material more elastic than the binding material 15 of the first grinding chips 11. The second grinding chips 12 are, as an example, formed by binding CBN abrasive grains with a grain size of #800 by the resinoid binding material 20 with a concentration ratio of 30 in a rectangular shape, for example, with a thickness of 4 to 8 mm. As the resinoid binding material 20, for example, phenol resin is used.

Therefore, the second grinding chips 12 are grinding chips being small in the grain diameter of the grindstone so that they are for finish grinding and being low in hardness and comparatively prone to wear. Although described later in detail, as shown in FIG. 3, the width in the axis direction is different among the four second grinding chips 12 possessed by, of the circumferentially-divided grinding chips A to P, the four circumferentially-divided grinding chips A to D, E to H, I to L and M to P adjoining in the circumferential direction.

As shown in FIG. 2, the mixture portions 18*a* to 18*p* are grindstone portions where, for example, CBN abrasive grains (the superabrasive grains 19) with a grain size of #800 possessed by the second grinding chips 12 and, for example, CBN abrasive grains (the superabrasive grains 14) with a grain size of #80 possessed by the first grinding chips 11 are substantially uniformly present in mixture. In the mixture portions 18*a* to 18*p*, the vitrified binding material 15 and the resinoid binding material 20 are also present in mixture. Therefore, the mixture portions 18*a* to 18*p* have the properties of both of the first grinding chips 11 and the second grinding chips 12, and the proneness to wear thereof is substantially intermediate between that of the first grinding chips 11 and that of the second grinding chips 12. It is desirable that the widths of the mixture portions 18*a* to 18*p* in the axis direction be widths capable of accommodating one to two superabrasive grains 14 and 19. The axial widths La (see the development view of FIG. 3) of the mixture portions 18*a* to 18*p* are substantially the same. Moreover, the thickness of the mixture portions 18*a* to 18*p* is substantially the same as that of the first grinding chips 11 and the second grinding chips 12.

The thus formed grinding chips 11, 12 and 11 and mixture portions 18*a* to 18*p* having the same thickness are arranged in the above-mentioned order in the axis direction on the outer peripheral surface of the disc-like base 13, whereby the circumferentially-divided grinding chips A to P are formed.

(Regarding the Overlap of the Mixture Portions 18*a* to 18*p*)

Figure 4:
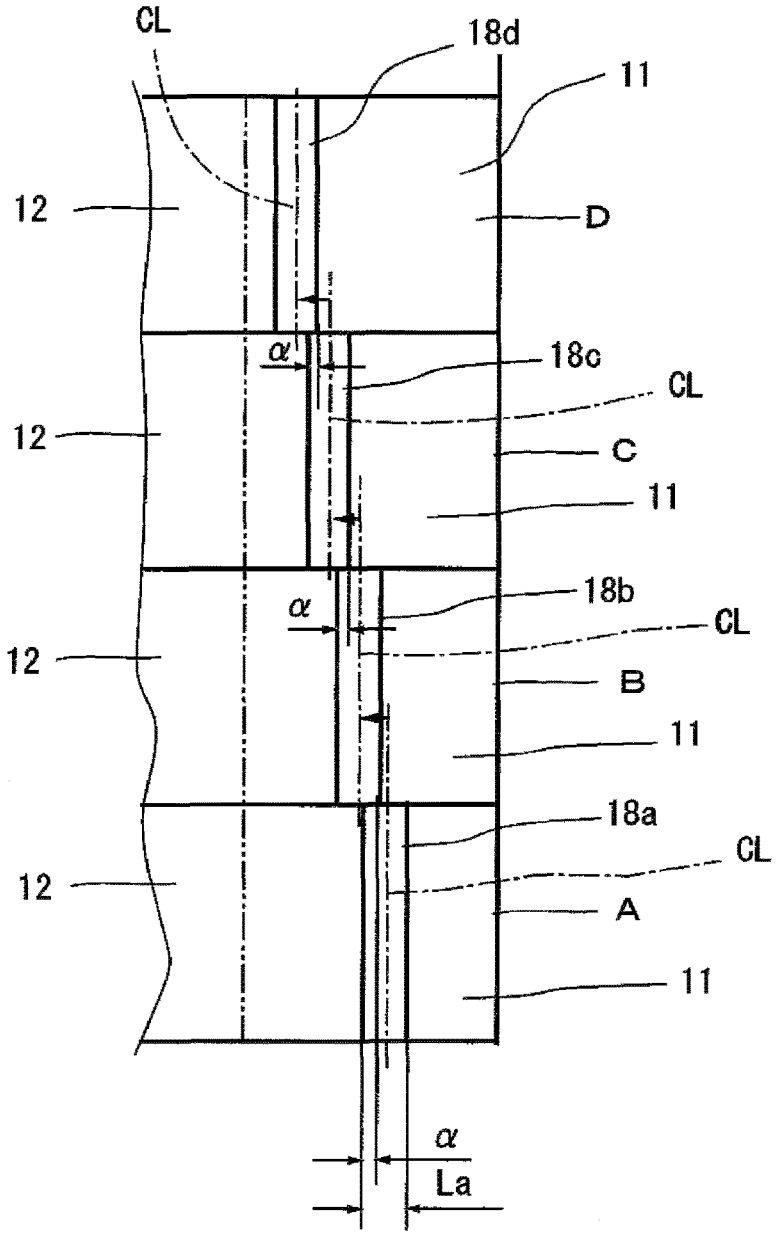
FIG. 4 is an enlarged view of the S portion of FIG. 3.

The above-mentioned FIG. 3 is a development view where the grinding layer 16 on the outer peripheral surface of the disc-like base 13 is developed around the axis. In this description, since the overlap of the mixture portions 18*a* to 18*p* adjoining in the circumferential direction is described, the circumferentially-divided grinding chips A to D are picked out and described as a representative. As shown in FIG. 4 which is an enlarged view of the S portion of FIG. 3, the mixture portion 18*a* on the right side of FIG. 1B possessed by the circumferentially-divided grinding chip A and the mixture portion 18*b* on the right side of FIG. 1B corresponding to the right side mixture portion 18*a* of the axis direction boundary portions possessed by the circumferentially-divided grinding chip B adjoining the circumferentially-divided grinding chip A in the circumferential direction are disposed so that the center positions (see the center lines CL) of the widths La of the mixture portions 18*a* and 18*b* in the axis direction do not coincide with each other. Moreover, as shown in FIG. 4, the mixture portion 18*a* and the mixture portion 18*b* are disposed so as to overlap by a predetermined amount $\alpha$ in the axis direction of the disc-like base 13.

Moreover, the arrangements between the circumferentially adjoining mixture portions 18*b* and 18*c*, and 18*c* and 18*d* have a similar relation to that between the mixture portion 18*a* and the mixture portion 18*b*. Further, regarding the other mixture portions 18*e* to 18*p*, the arrangements between the circumferentially adjoining mixture portions have a similar relation to that between the mixture portion 18*a* and the mixture portion 18*b*. However, the values of the predetermined overlap amounts a are not necessarily the same.

In the following, when the mixture portions 18*a* to 18*p* two of which the circumferentially-divided grinding chips A to P each have are described, unless otherwise mentioned, description will be given only with respect to the mixture portions 18*a* and 18*p* on the right side in FIG. 3.

Moreover, as shown in FIG. 3 and FIG. 4, in the present embodiment, the center positions in the axis direction of the mixture portions 18*a* to 18*d* and 18*i* to 18*l* of the four (corresponding to the at least three) circumferentially-divided grinding chips A to D and I to L continuously arranged in the circumferential direction on the outer peripheral surface are arranged leftward (corresponding to the predetermined direction) in the axis direction in FIG. 3 and FIG. 4 in the order in which the four circumferentially-divided grinding chips A to D and I to L are continuously arranged in the circumferential direction.

Moreover, the center positions in the axis direction of the mixture portions 18*e* to 18*h* and 18*m* to 18*p* of the four (corresponding to the at least three) circumferentially-divided grinding chips E to H and M to P continuously arranged in the circumferential direction on the outer peripheral surface are arranged rightward (the predetermined direction) in the axis direction in FIG. 3 and FIG. 4 in the order in which the four circumferentially-divided grinding chips E to H and M to P are continuously arranged in the circumferential direction. By this arrangement of the circumferentially-divided grinding chips A to P, the mixture portions 18*a* to 18*p* are provided with a large width in the axis direction and can form a continuous and rounded large curve shape.

Such a rounded curve shape is freely obtained by adjusting the predetermined amounts a of the overlap in the axis direction between the mixture portions 18*a* to 18*p* adjoining in the circumferential direction on the outer peripheral surface. As the shape of the curve, a grinding test is actually performed and a shape where the amount of wear caused on the mixture portions 18*a* to 18*p* is excellently suppressed is selected, and the shape may be any shape. In this case, for example, the mixture portions 18*a* to 18*p* may be arranged so that a SIN curve is formed when the middle points in the circumferential direction at the center positions (CL) of the mixture portions 18*a* to 18*p* in the axis direction are smoothly connected in the alphabetical order of the indices of the mixture portions 18*a* to 18*p*.

Moreover, as shown in FIG. 1B, the mixture portions 18*a* to 18*p* (the axis direction boundary portions) formed between the first grinding chips 11 and the second grinding chips 12 are disposed on parts of the R portions at both ends in the axis direction of the outer peripheral surface on the outer peripheral surface of the disc-like base 13. That is, the first grinding chips 11 and 11 are disposed on parts of the R portions, respectively, and the second grinding chips 12 are disposed on the cylindrical portion (C portion) and the remaining parts of the R portions.

In the above, of the mixture portions 18*a* to 18*p* two of which the circumferentially-divided grinding chips A to P each have, only the mixture portions 18*a* to 18*p* on the right side in FIG. 3 are described. However, the mixture portions 18*a* to 18*p* on the left side in FIG. 3 are formed similarly.

(Method for Manufacturing the Circumferentially-Divided Grinding Chips A to P)

Next, the method for manufacturing the circumferentially-divided grinding chips A to P will be described. To manufacture the first grinding chip 11, first, powder mixed with the superabrasive grains 14, the binding material 15 and the like is filled with a uniform thickness onto a lower press mold of a concave rectangular form. Thereafter, the powder filled onto the lower press mold is pressed by a first upper mold, so that a grinding chip is molded in a rectangular shape. Then, the press-molded grinding chip is dried, and after dried, fired to complete the first grinding chip 11. The second grinding chip 12 is manufactured by a similar method to the first grinding chip 11 with only difference being that the superabrasive grains 14 and the binding material 15 are changed to the superabrasive grains 19 and the binding material 20.

The mixture portions 18*a* to 18*p* are manufactured by performing firing under the condition where the boundary portions between the first grinding chips 11 and the second grinding chips 12 are in contact with each other. In the neighborhood of the contact portions of the fired first grinding chips 11 and second grinding chips 12, the binding material 15 and the binding material 20 are melted. Under this condition, the superabrasive grains 14 and 19 of the first grinding chips 11 and the second grinding chips 12 are mixed together to form the mixture portions 18*a* to 18*p*.

The thus formed circumferentially-divided grinding chips A to P are continuously pasted by an adhesive agent (not shown) to the entire periphery in the circumferential direction of the outer peripheral surface of the disc-like base 13 according to the above-described arrangement rule.

(Structure of a Grinder 25)

Figure 5:
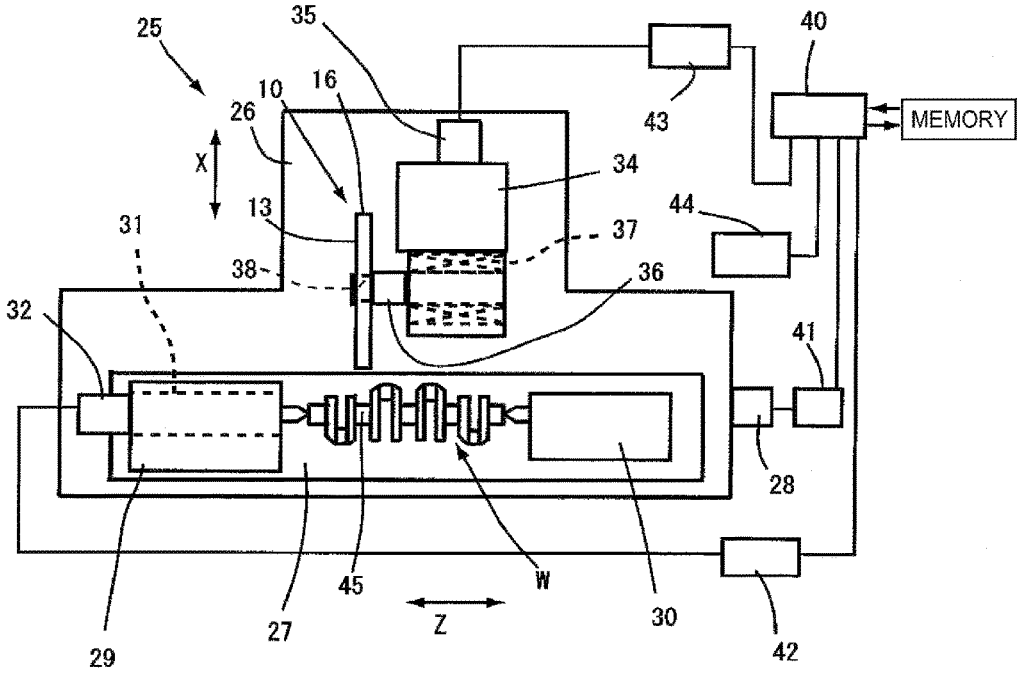
FIG. 5 is a view showing a grinder to which the grinding wheel according to the first embodiment is attached.

Next, the grinder 25 to which the grinding wheel 10 is attached to grind a workpiece W will be described based on FIG. 5. As shown in FIG. 5, on a bed 26, a table 27 is slidably placed and moved in a Z-axis direction through a ball screw by a servo motor 28. On the table 27, a headstock 29 and a tailstock 30 are attached so as to be opposed to each other, and the workpiece W is supported at the center in the Z axis direction between the headstock 29 and the tailstock 30. On the headstock 29, a main shaft 31 is rotatably supported, and rotated by a servo motor 32. The workpiece W is coupled to the main shaft 31 by a lathe dog or the like to be rotated.

On the bed 26, a grinding wheel head 34 is slidably placed, and is moved by a servo motor 35 through a ball screw in an X-axis direction orthogonally intersecting with the Z axis. On the grinding wheel head 34, a grinding wheel spindle 36 is rotatably supported, and rotated by a built-in motor 37. To the end of the grinding wheel spindle 36, a central hole 38 drilled in the disc-like base 13 of the grinding wheel 10 is fitted and fixed by a bolt.

A CNC device 40 is connected to driving circuits 41 to 44 of the servo motors 28, 32 and 35 and the built-in motor 37. The CNC device 40 successively executes NC programs for grinding at the time of grinding to cause the grinding wheel 10 to grind the workpiece W.

(Regarding the Operation of the Grinder)

When causing the grinding wheel 10 to grind the workpiece W, the CNC device 40 executes NC programs for grinding, and outputs a rotation instruction to rotate the grinding wheel 10 at a high rotation speed to the driving circuit 44 of the built-in motor 37. Moreover, the CNC device 40 outputs a rotation instruction to rotate the workpiece W at a circumferential speed suitable for grinding to the driving circuit 42 of the servo motor 32 that rotates the main shaft 31. Then, a sending instruction to move the table 27 in the Z-axis direction to a position where the workpiece W is opposed to the grinding wheel 10 is outputted to the driving circuit 41 of the servo motor 28.

When the grinding wheel 10 is opposed to the part to be ground of the workpiece W, an instruction to advance the grinding wheel head 34 in the X-axis direction at a rough grinding sending speed is outputted to the driving circuit 43 of the servo motor 35. Thereby, the grinding wheel 10 grinds the workpiece W while being supplied with a coolant from a non-illustrated coolant nozzle.

Figure 6:
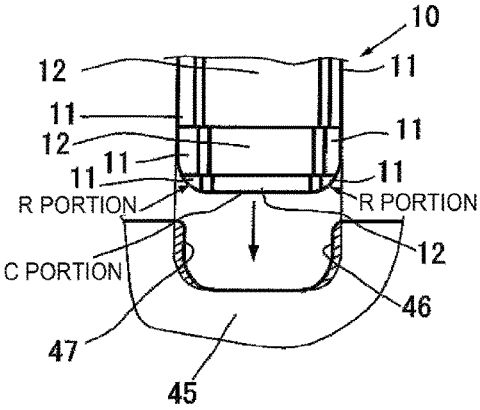
FIG. 6 is a view showing a relation between the grinding wheel according to the first embodiment and a workpiece W.

Next, a case where the workpiece W is ground by the grinding wheel 10 will be described in detail. As mentioned previously, the workpiece W is a crank shaft, and the part to be ground is, for example, a crank journal 45 and rotation axis direction side surfaces 46 and 47 of the crank journal shown in FIG. 6 which are a concave portion of the crank shaft. Hereinafter, there will be cases where the crank journal 45 and the rotation axis direction side surfaces 46 and 47 are referred to merely as concave portion. As shown in FIG. 6, the grinding wheel 10 is a form grinding stone, and has a shape slightly larger than the concave portion in the axis direction (Z-axis direction). For this reason, when the grinding wheel 10 cuts into the concave portion, the grinding wheel 10 cuts the side surfaces 46 and 47 (the hatched parts) of the concave portion while removing them by grinding with the axis direction both end portions (R portions) provided with the first grinding chips 11 that are resistant to wear. Then, when the cylindrical portion (C portion) of the outer peripheral surface of the grinding wheel 10 reaches the outer peripheral surface of the crank journal 45 which is the bottom surface of the concave portion, the bottom surface of the concave portion (the outer peripheral surface of the crank journal 45) is ground by the second grinding chips 12 that are prone to wear, thereby performing finishing.

At this time, the mixture portions 18*a* to 18*p* of the circumferentially-divided grinding chips A to P are formed so as to have a rounded curve in the circumferential direction of the outer peripheral surface of the grinding wheel 10. That is, the mixture portions 18*a* to 18*p* are formed in a shape where wear is easily suppressed when the workpiece W is ground. For this reason, the occurrence of a level difference due to wear on the mixture portions 18*a* to 18*p* between the first grinding chips 11 being resistant to wear and the second grinding chips 12 being prone to wear is effectively suppressed.

Moreover, as shown in FIG. 1B, the mixture portions 18*a* to 18*p* (the axis direction boundary portions) formed between the first grinding chips 11 and the second grinding chips 12 are disposed on parts of the R portions at both ends in the axis direction of the outer peripheral surface on the outer peripheral surface. That is, the first grinding chips 11 and 11 are disposed on parts of the R portions, respectively, and the second grinding chips 12 are disposed on the cylindrical portion and the remaining parts of the R portions. For this reason, the mixture portions 18*a* to 18*p* are not disposed on the cylindrical portion (C portion). Therefore, even if the mixture portions 18*a* to 18*p* are worn to cause a level difference, the level difference is not transferred to the bottom surface of the concave portion (the outer peripheral surface of the crank journal 45) of the workpiece W grounded by the second grinding chips 12 provided on the cylindrical portion (C portion), so that excellent finishing accuracy can be obtained.

(Advantages of the Embodiment)

As is apparent from the above description, according to the first embodiment, the grinding wheel 10 is a grinding wheel 10 provided with the disc-like base 13 (the disc-like member) and the grinding layer 16 disposed on the outer peripheral surface of the disc-like base 13, the grinding layer 16 is provided with the plurality of (sixteen) circumferentially-divided grinding chips A to P divided in the circumferential direction, and the circumferentially-divided grinding chips A to P are each formed by arranging the first grinding chips 11 and the second grinding chip 12 having different properties in the axis direction. On each of the plurality of (sixteen) circumferentially-divided grinding chips A to P, the boundary portions between the first grinding chips 11 and the second grinding chip 12 are defined as axis direction boundary portions. The axis direction boundary portions of, of the plurality of (sixteen) circumferentially-divided grinding chips A to P, the four (at least three) circumferentially-divided grinding chips A to D and I to L or circumferentially-divided grinding chips E to H and M to P continuously arranged in the circumferential direction are arranged toward the predetermined direction in the axis direction in the order of the four (at least three) circumferentially-divided grinding chips A to D and I to L or circumferentially-divided grinding chips E to H and M to P continuously arranged in the circumferential direction.

Thereby, the axis direction boundary portions of the four (at least three) circumferentially-divided grinding chips A to D and I to L or circumferentially-divided grinding chips E to H and M to P are continuously arranged with a large width in the axis direction in the circumferential direction of the outer peripheral surface compared with the conventional art where the two boundary portions are always arranged so as to be staggered in the axial direction in the circumferential direction. For this reason, the level difference due to the wear between the first grinding chips 11 and the second grinding chips 12 caused because of the difference in properties can be made gentler than the level difference due to the wear between the two kinds of grinding layers caused because of the difference in properties in the conventional art, so that the finishing accuracy of the workpiece W can be made excellent.

Moreover, a difference in the degree of the level difference due to the wear caused between the first grinding chips 11 and the second grinding chips 12 is caused according to the degree of the difference in properties (the grain diameter, hardness, kind of the binding material, or the like of the grindstones) between the first and second grinding chips 11 and 12. At this time, the amounts of change of the axial positions of the axis direction boundary portions of the circumferentially-divided grinding chips A to P continuously arranged in the circumferential direction of the grinding wheel 10 are changed according to the degree of the level difference. For example, when the level difference is too large, change is made so that the amount of change of the axial positions of the axis direction boundary portions, that is, the predetermined amounts a of the overlap in the axis direction of the axis direction boundary portions adjoining in the circumferential direction are reduced and that the widths of change of the axis direction boundary portions in the axis direction are increased. Moreover, when the level difference is small, the predetermined amounts a of the overlap in the axis direction which are the amount of change of the axial positions of the axis direction boundary portions may be increased. By doing this, the level difference of the grinding layer 16 due to wear can be efficiently dispersed, so that the finishing accuracy of the workpiece W can be made more excellent.

Moreover, according to the first embodiment, the first grinding chips 11 are large in the grain diameter of the abrasive grains and high in hardness, the second grinding chips 12 are small in the grain diameter of the abrasive grains and low in hardness, the first grinding chips 11 are disposed on both end portions of the grinding layer 16 in the axis direction, and the second grinding chips 12 are disposed in the central portion of the grinding layer 16 in the axis direction.

Thereby, for example, when the concave portion of the cylindrical workpiece W provided with the concave portion on the entire periphery is ground, it can be excellently ground. That is, since the inside side surface of the concave portion where the grinding amount is large and the grinding resistance is high is ground by the grinding layer 16 formed of the first grinding chips 11 being large in the grain diameter of the abrasive grains and high in hardness, the wear of the grinding layer 16 is suppressed. Moreover, since the bottom surface of the concave portion where the grinding resistance is low is ground by the grinding layer 16 formed of the second grinding chips 12 being small in the grain diameter of the abrasive grains and low in hardness, finishing accuracy is improved.

Moreover, according to the first embodiment, the grinding layer 16 is provided with the cylindrical portion (C portion) and the R portions disposed at both ends of the cylindrical portion (C portion), the first grinding chips 11 are disposed on parts of the R portions, the second grinding chips 12 are disposed on the cylindrical portion and the remaining parts of the R portions, and the axis direction boundary portions are disposed on parts of the R portions. At this time, the parts of the R portions are not in direct contact with the cylinder outer peripheral surface of the workpiece W. For this reason, even if a level difference due to wear is caused on the axis direction boundary portions formed on the parts of the R portions, the level difference is not transferred to the cylinder outer peripheral surface of the workpiece W, so that finishing accuracy is excellent.

Moreover, according to the first embodiment, the axis direction boundary portions have predetermined widths in the axis direction, and in the widths, the abrasive grains of the first and second grinding chips 11 and 12 having different properties and disposed at both ends of the axis direction boundary portions in the axis direction are present in mixture to form the mixture portions 18*a* to 18*p*.

In the mixture portions 18*a* to 18*p*, since the two kinds of abrasive grains 14 and 19 having different properties are present in mixture, the amounts of wear of the mixture portions 18*a* to 18*p* are values between the amounts of wear of the first and second grinding chips 11 and 12 on both sides in the axis direction of the mixture portions 18*a* to 18*p*. For this reason, after worn, the mixture portions 18*a* to 18*p* connect the first and second grinding chips 11 and 12 on both sides of the mixture portions 18*a* to 18*p* with a gentle inclination, thereby effectively suppressing the occurrence of a level difference of a steep inclination between the first and second grinding chips 11 and 12.

Moreover, according to the first embodiment, the amounts (the predetermined amounts $\alpha$) of overlap in the axis direction of the mixture portions 18*a* to 18*p* with the mixture portions adjoining in the circumferential direction of the outer peripheral surface of the disc-like base 13 (the disc-like member) are changed.

By thus changing the predetermined amount $\alpha$ of the overlap between the mixture portions 18*a* to 18*p*, the configuration of continuously connecting the axis direction boundary portions in the circumferential direction of the outer peripheral surface of the disc-like base 13 can be made a desired configuration in the circumferential direction of the outer peripheral surface. For example, the mixture portions 18*a* to 18*p* may be arranged by adjusting the predetermined amount $\alpha$ of the overlap so that when the middle points in the circumferential direction at the center positions of the mixture portions 18*a* to 18*p* in the axis direction are smoothly connected in the alphabetical order of the indices of the mixture portions 18*a* to 18*p*, the connected curved line forms a SIN curve. Thereby, the level difference caused, due to wear, between the first grinding chips 11 and the second grinding chips 12 having different properties can be made to have a predetermined shape and size, so that the finishing accuracy of the workpiece W can be made extremely excellent. Moreover, if the above-mentioned advantage is combined with the advantage of the mixture portions 18*a* to 18*p* themselves that makes the level difference a gentle inclination, the advantage is further enhanced.

Second Embodiment

Figure 7:
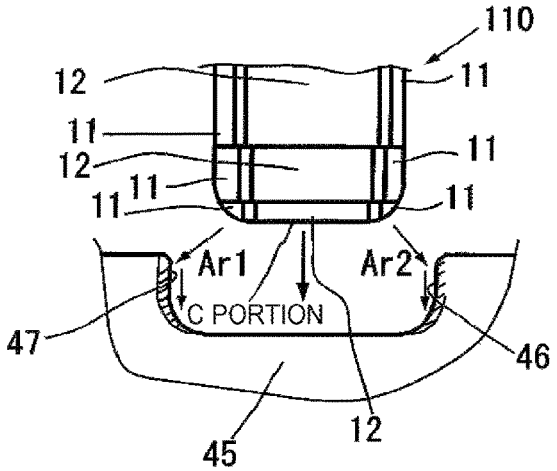
FIG. 7 is a view showing a relation between a grinding wheel according to a second embodiment and the workpiece W.

Next, a second embodiment will be described. The second embodiment is different from the first embodiment only in the relative size to the size of the concave portion which is the object to be ground by the grinding wheel. In the first embodiment, the grinding wheel 10 is a form grinding stone having a cross sectional shape larger than the concave portion on the outer peripheral surface. However, in the second embodiment, as shown in FIG. 7, a grinding wheel 110 has a size accommodatable in the concave portion. The structure of the grinding wheel 110 is similar to that of the grinding wheel 10 of the first embodiment. Therefore, description will be given with similar elements being denoted by similar reference designations to those in the first embodiment.

A case where the workpiece W is ground by the grinding wheel 110 will be described. As mentioned above, the workpiece W is the crank shaft, and the object to be ground is the concave portion of the crank shaft. As shown in FIG. 7, the grinding wheel 110 is formed in a size accommodatable in the concave portion in the axis direction. For this reason, the grinding wheel 110 cuts in the directions of the arrow Ar1 and the arrow Ar2 shown in FIG. 7 to remove the axis direction side surfaces 46 and 47 of the concave portion by grinding. That is, the grinding wheel 110 removes the side surfaces 46 and 47 of the concave portion with the axis direction end portions (R portions) having the first grinding chips 11 that are resistant to wear. Then, when the removal of the side surfaces 46 and 47 is finished, the outer peripheral surface of the grinding wheel 110 reaches the bottom surface (outer peripheral surface) of the concave portion, and finish grinding of the bottom surface of the concave portion is performed by the cylindrical portion (C portion) of the outer peripheral surface of the grinding wheel 110 provided with the second grinding chips 12 that are prone to wear. Except for the above, all are similar to the first embodiment. By this embodiment, similar advantages to those of the first embodiment are obtained.

According to the method for manufacturing the grinding wheel 10 in the above-described first and second embodiments, the grinding layer 16 is formed by arranging the already formed sixteen (a plurality of) circumferentially-divided grinding chips A to P on the outer peripheral surface of the disc-like base 13 (the disc-like member). However, the present invention is not limited to this manufacturing method; it may be manufactured by separately pasting the first and second grinding chips 11 and 12 constituting the circumferentially-divided grinding chips A to P to the outer peripheral surface without previously forming the circumferentially-divided grinding chips A to P. In this case, the circumferentially-divided grinding chips A to P are not provided with the mixture portions 18*a* to 18*p* and provided with only axis direction boundary portions having no width or entity. That is, the first grinding chips 11 and the second grinding chips 12 are made to adjoin without the mixture portions 18*a* to 18*p* interposed therebetween. By this, adequate advantages are also obtained.

Moreover, the mixture portions 18*a* to 18*p* of the circumferentially-divided grinding chips A to P may be manufactured by a manufacturing method different from that of the present embodiment. That is, the mixture portions 18*a* to 18*p* may be manufactured singly by pressing and be interposed between the first grinding chips 11 and the second grinding chips 12. By this, similar advantages to those of the above-described embodiments are obtained.

Moreover, while in the first and second embodiments, sixteen circumferentially-divided grinding chips are arranged in the circumferential direction, the number may be larger than this or smaller than this.

Moreover, in the first and second embodiments, as shown in FIG. 1B, the mixture portions 18*a* to 18*p* (the axis direction boundary portions) formed between the first grinding chips 11 and the second grinding chips 12 are provided on parts of the R portions at both ends of the grinding layer 16. However, the present invention is not limited to the embodiments; the mixture portions 18*a* to 18*p* may be provided on the remaining parts of the R portions or the cylindrical portion. By this, adequate advantages are also obtained.

Moreover, in the first and second embodiments, for the workpiece W made of one kind of material, the grinding wheels 10 and 110 are structured by combining the two kinds of first and second grinding chips 11 and 12 according to the shape parts with different grinding resistances. However, the present invention is not limited to the embodiments; for a workpiece where a plurality of kinds of materials are joined together, a grinding wheel may be structured by combining grinding chips according to the materials. By this, similar advantages to those of the above-described embodiments are obtained.

Third Embodiment (Structure of a Grinding Wheel)

Figure 8A:
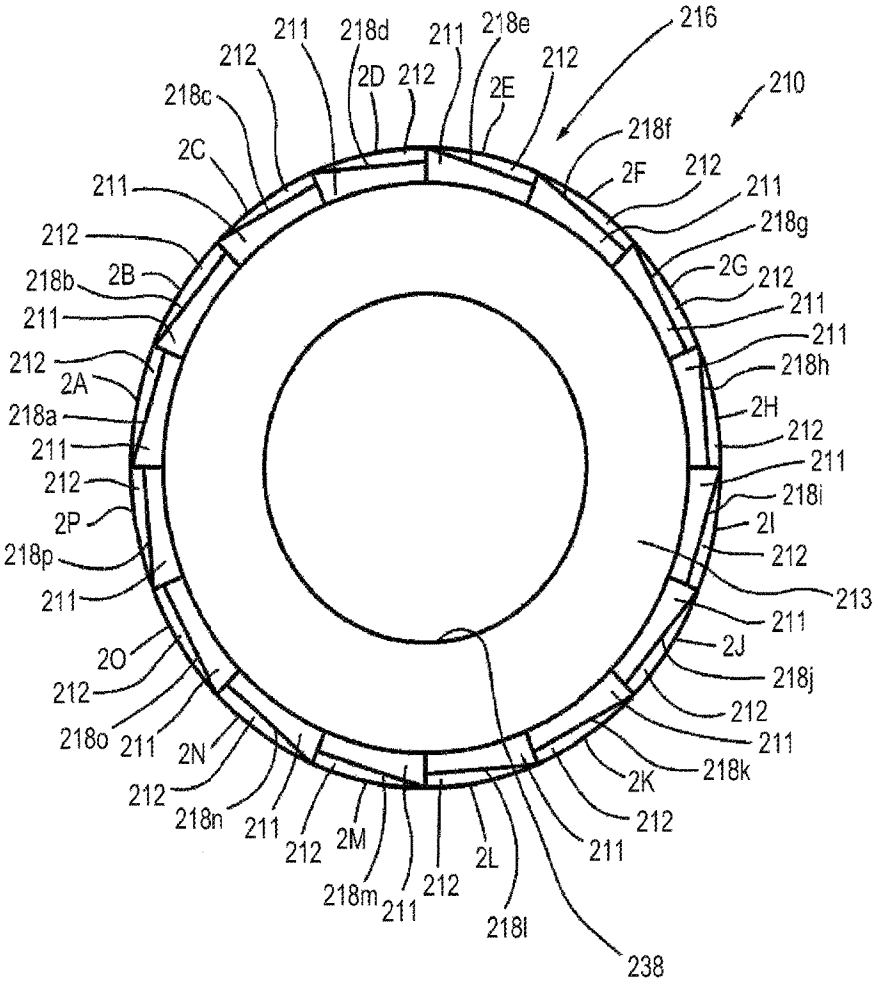
FIG. 8A is a front view showing a grinding wheel according to a third embodiment.

Hereinafter, a third embodiment of the grinding wheel of the present invention will be described based on the drawings. As shown in FIG. 8A, a grinding wheel 210 is provided with a disc-like base 213 (corresponding to an example of the disc-like member) and a grinding layer 216 disposed on the outer peripheral surface of the disc-like base 213. The disc-like base 213 is molded of a metal such as iron or aluminum, a resin, or the like. The disc-like base 213 is rotated around the rotation axis of the grinding wheel 210 (hereinafter, referred to merely as around the axis).

Hereinafter, when the term axis is used without any special explanation, it means the rotation axis of the grinding wheel 210. Moreover, when the term axis direction is used without any special explanation, it means the direction of the rotation axis of the grinding wheel 210. The grinding layer 216 is provided with a plurality of (sixteen in the present embodiment) circumferentially-divided grinding chips 2A to 2P equally divided in the circumferential direction. While in the third embodiment, the circumferentially-divided grinding chips 2A to 2P are all formed in the preset same shape, for convenience of explanation, they are indicated being divided into the circumferentially-divided grinding chips 2A to 2P. The grinding wheel 210 is a form grinding wheel the object to be grounded of which is a concave groove provided on the outer periphery such as the crank pin or the journal of a vehicular crank shaft.

Figure 8B:
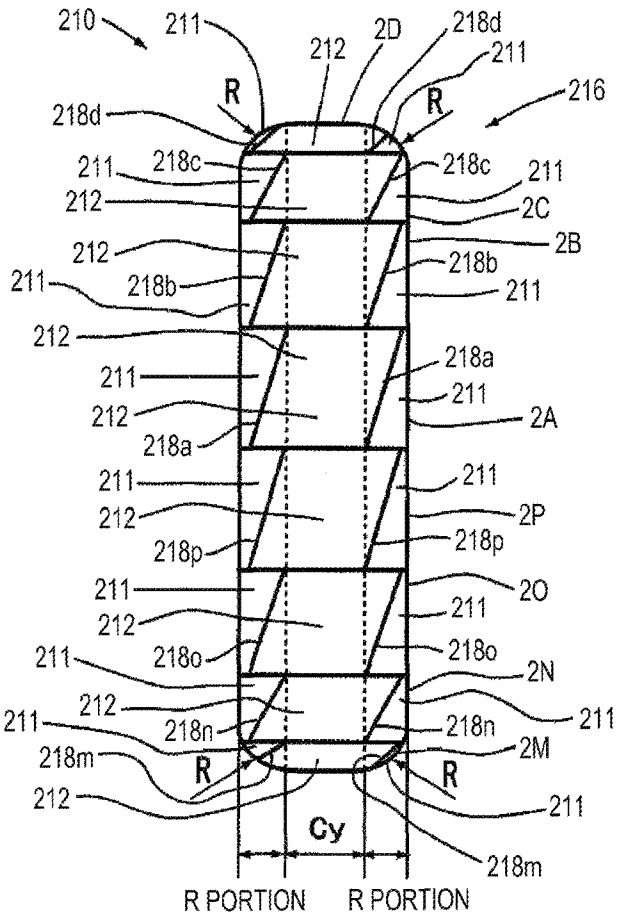
FIG. 8B is a side view of the grinding wheel of FIG. 8A.
Figure 9:
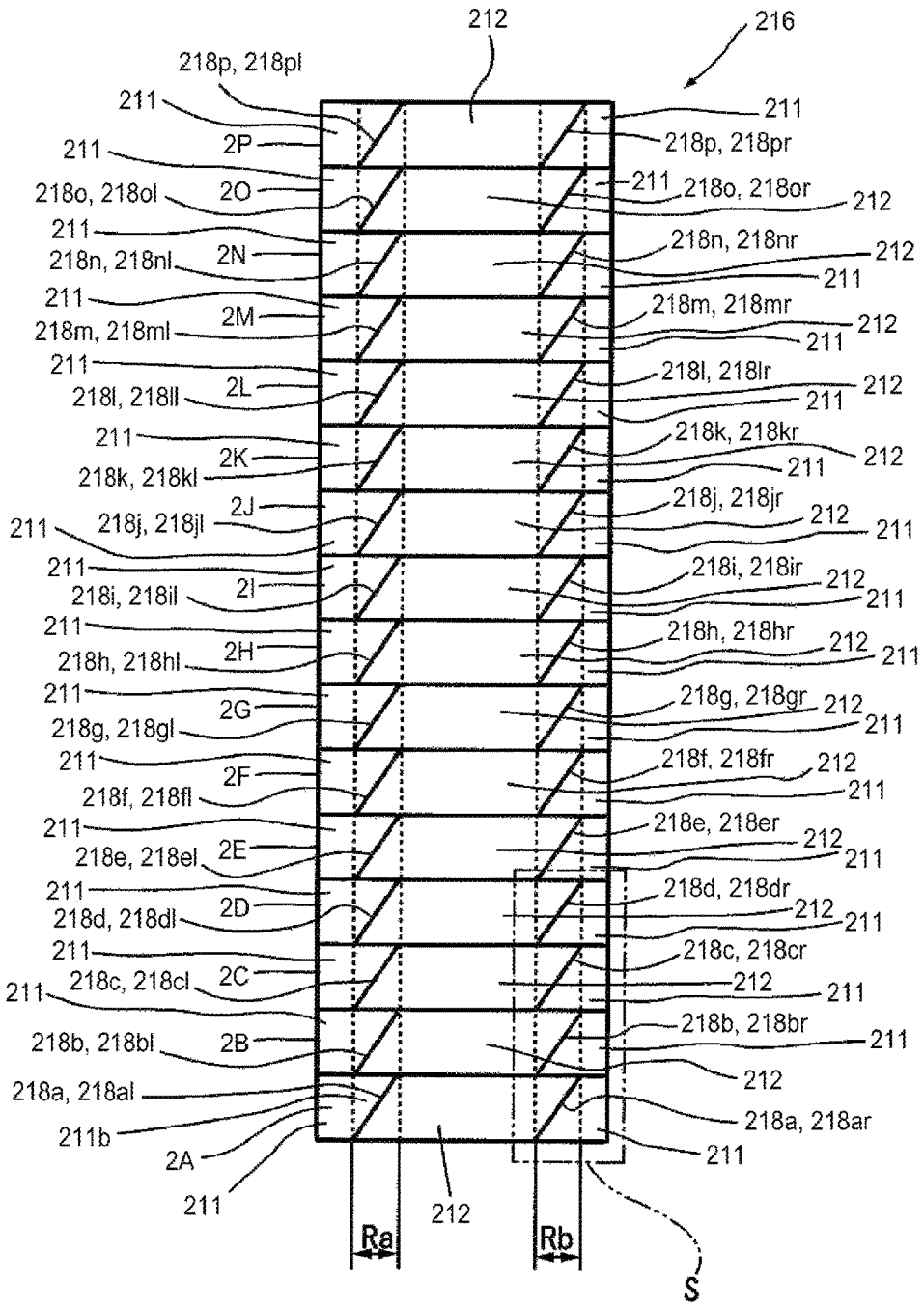
FIG. 9 is a development view of the surroundings of the axis of the grinding layer.

As shown in FIG. 8B, and FIG. 9 where the circumferentially-divided grinding chips 2A to 2P are planarly developed in the circumferential direction of the disc-like base 213 of the grinding wheel 210 and around the axis, the circumferentially-divided grinding chips 2A to 2P are each provided with two first grinding chips 211, one second grinding chip 212 and boundary portions 218*a* to 218*p* in two positions. The first grinding chips 211, the second grinding chips 212 and the boundary portions 218*a* to 218*p* are arranged in a state of being arranged in a preset order in the axis direction on the circumferentially-divided grinding chips 2A to 2P (see FIG. 10). The predetermined order is the order of, from the left side (or the right side) of FIG. 10, the first grinding chip 211, the boundary portions 218*a* to 218*p*, the second grinding chip 212, the boundary portions 218*a* to 218*p* and the first grinding chip 211. The first grinding chips 211 and the second grinding chips 212 have different properties as grindstones (details will be described later). The boundary portions 218*a* to 218*p* are contact portions and boundary portions between the first grinding chips 211 and the second grinding chips 212.

(Detailed Description of the Boundary Portions 218*a* to 218*p*)

As shown in FIG. 8B and FIG. 9, all the boundary portions 218*a* to 218*p* on the left side of the circumferentially-divided grinding chips 2A to 2P are formed in the same shape. Moreover, all the boundary portions 218*a* to 218*p* on the right side of the circumferentially-divided grinding chips 2A to 2P are also formed in the same shape. In the present embodiment, the right and left boundary portions 218*a* to 218*p* all have the same shape. While the right and left boundary portions 218*a* to 218*p* have the same shape as mentioned above, for convenience of explanation, in the following, the boundary portions 218*a* to 218*p* on the left side of the circumferentially-divided grinding chips 2A to 2P are denoted as boundary portions 218*al* to 218*pl*. Likewise, the boundary portions 218*a* to 218*p* on the right side of the circumferentially-divided grinding chips 2A to 2P are denoted as boundary portions 218*ar* to 218*pr* (see FIG. 9).

Figure 10:
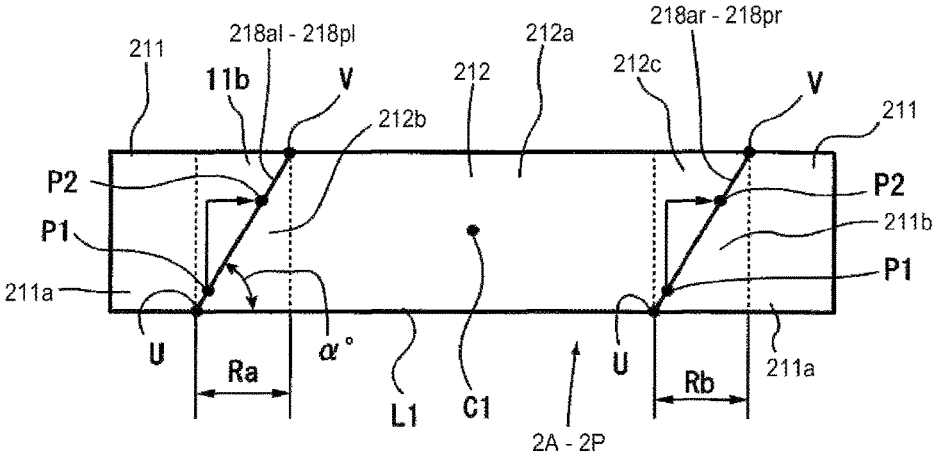
FIG. 10 is an enlarged view of circumferentially-divided grinding chips 2A to 2P.

As shown in FIG. 10 showing the circumferentially-divided grinding chips 2A to 2P, the boundary portions 218*al* to 218*pl* on the left side and the boundary portions 218*ar* to 218*lr* on the right side are provided so that the angles α° with respect to a boundary line L1 with one circumferentially-divided grinding chips of the circumferentially-divided grinding chips that the circumferentially-divided grinding chips 2A to 2P adjoin on both sides in the circumferential direction are the same angle, that is, the same inclination with respect to the axis direction. Thereby, the second grinding chip 212 side end surfaces of the two first grinding chips 211 of the circumferentially-divided grinding chips 2A to 2P forming the boundary portions 218*al* to 218*pl* and 218*ar* to 218*pr* are formed parallel to each other.

In the above, the angles α° of the boundary portions 218*al* to 218*pl* and 218*ar* and 218*pr* formed with respect to the boundary line L1 are angles in a case where the grinding layer 216 is developed in the circumferential direction into a planar state as shown in FIG. 10. The boundary line L1 is a line parallel to the axis in the planar state into which the grinding layer 216 is developed in the circumferential direction under a condition where the axis is projected. Therefore, it can be said that the angles α° are angles with respect to the axis in the planar state into which the grinding layer 216 is developed in the circumferential direction under a condition where the axis is projected to any position of the grinding layer 216.

From the above, the right and left first grinding chips 211 can be formed in a point symmetry form with respect to the barycenter C1 of the second grinding chips 212, so that the same grinding chips can be used as the right and left first grinding chips 211. Thereby, in the present embodiment, thirty-two first grinding chips 211 molded with the same mold can be used as the sixteen first grinding chips 211, on each of the right and left sides, of the grinding wheel 210 in FIG. 9, which is efficient.

As shown in FIG. 10, the first grinding chips 211 are each provided with a main portion 211*a* and an extended portion 211*b*. And the first grinding chips 211 are, as shown in FIG. 8B, disposed in angular portions (R portions) as both ends in the axis direction which angular portions are formed in an R shape on the outer peripheral surface of the disc-like base 213. Of the first grinding chips 211, the extended portions 211*b* are disposed in an area Ra and an area Rb which are areas where the boundary portions 218*al* to 218*pl* and 218*ar* to 218*pr* are present in the axis direction. Therefore, the main portions 211*a* are disposed mainly on the side surfaces of the angular portions (R portions) which are positions other than the area Ra and the area Rb in the angular portions (R portions). The area Ra is an area in the axis direction where the left side boundary portion 218*al* is present in FIG. 10. The area Rb is an area in the axis direction where the right side boundary portion 218*ar* is present in FIG. 10.

As shown in FIG. 10, the second grinding chips 212 are each provided with a main portion 212*a* and extended portions 212*b* and 212*c* on both sides in the axis direction. The main portion 212*a* is disposed on a cylindrical portion Cy of the outer peripheral surface of the disc-like base 213. Moreover, the extended portions 212*b* and 212*c* are disposed in the areas Ra and Rb. Specifically, the extended portions 212*b* and 212*c* extend in the direction of the first grinding chips 211 from both ends in the axial direction of the main portion 212*a* disposed on the cylindrical portion Cy in such a manner as to be in contact with the end portions in the axial direction of the extended portions 211*b* and 211*b* of the first grinding chips 211.

As described previously, the boundary portions which are portions where the extended portions 212*b* and 212*c* of the second grinding chips 212 and the extended portions 211*b* and 211*b* of the first grinding chips 211 are in contact are formed with the same inclination with respect to the axis direction of the grinding wheel 210. Specifically, the boundary portions 218*al* to 218*pl* and 218*ar* to 218*pr* formed by the contact portions (boundaries) between the extended portions 212*b* and 212*c* of the second grinding chips 212 and the extended portions 211*b* and 211*b* of the first grinding chips 211 are formed of straight lines having the same inclination $\alpha°$ from one end U to the other end V shown in FIG. 10 in the circumferential direction of the grinding layer 216 and in a planar state of being developed around the axis.

That is, the shape of the boundary portions 218*al* to 218*pl* and 218*ar* to 218*pr* is a shape connecting positions (for example, points P1 and P2) that are different in the axis direction. In other words, the shape of the boundary portions 218*al* to 218*pl* and 218*ar* to 218*pr* has a displacement component in the axis direction in the developed planar state. Moreover, in other words, the shape of the boundary portions 218*al* to 218*pl* and 218*ar* to 218*pr* is a shape continuously connected in the same direction in the axis direction from the one end U toward the other end V in the developed planar state, and is linear.

Figure 11:
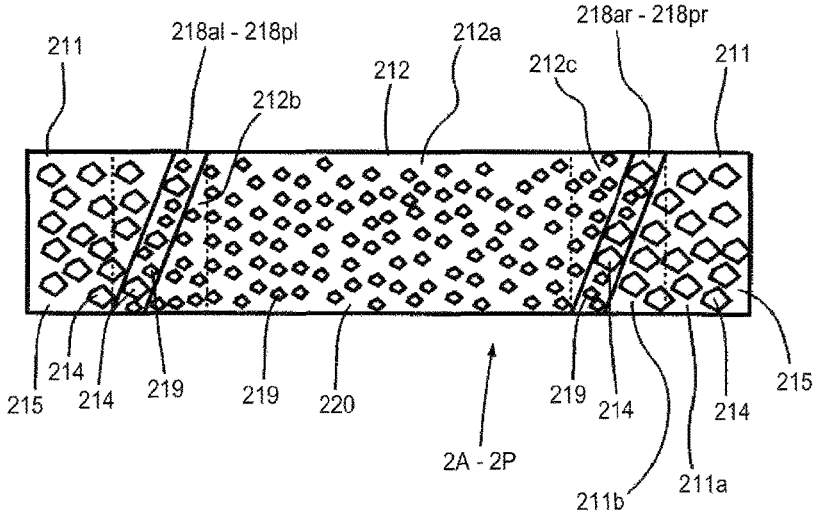
FIG. 11 is a schematic view for explaining the surface condition of the circumferentially-divided grinding chips 2A to 2P.

As shown in FIG. 11, the first grinding chips 211 are formed by binding superabrasive grains 214 such as CBN or diamond by a binding material 215. FIG. 11 is a schematic view showing an enlargement of the surface condition of the circumferentially-divided grinding chips 2A to 2P. The first grinding chips 211 are, as an example, formed by binding CBN abrasive grains with a grain size of #80 by the vitrified binding material 215 with a concentration ratio of 200, for example, with a thickness of 4 to 8 mm. Therefore, the first grinding chips 211 are grinding chips being large in the grain diameter of the grindstone so that they are for rough grinding and being high in hardness and comparatively resistant to wear.

As shown in FIG. 11, the second grinding chips 212 are formed by binding superabrasive grains 219 such as CBN or diamond by a binding material 220. The binding material 220 is a binding material more elastic than the binding material 215 of the first grinding chips 211. The second grinding chips 212 are, as an example, formed by binding CBN abrasive grains with a grain size of #800 by the resinoid binding material 220 with a concentration ratio of 30, for example, with a thickness of 4 to 8 mm. As the resinoid binding material 220, for example, phenol resin is used. Therefore, the second grinding chips 212 are grinding chips being small in the grain diameter of the grindstone so that they are for finish grinding and being low in hardness and comparatively prone to wear.

As shown in FIG. 11, the boundary portions 218*al* to 218*pl* and 218*ar* to 218*pr* have a minute width when observed in detail, and, for example, CBN abrasive grains (the superabrasive grains 219) with a grain size of #800 possessed by the second grinding chips 212 and, for example, CBN abrasive grains (the superabrasive grains 214) with a grain size of #80 possessed by the first grinding chips 211 are present in mixture. In the boundary portions 218*al* to 218*pl* and 218*ar* to 218*pr*, the vitrified binding material 215 and the resinoid binding material 220 are also present in mixture. Therefore, the boundary portions 218*a* to 218*p* have the properties of both of the first grinding chips 211 and the second grinding chips 212, and the proneness to wear thereof is substantially intermediate between the proneness to wear of the first grinding chips 211 and the proneness to wear of the second grinding chips 212.

The width of the boundary portions 218*al* to 218*pl* and 218*ar* to 218*pr* is a width that can accommodate one to two superabrasive grains 214 and 219, and is a resulting width caused at the time of firing described later. Moreover, the thickness of the boundary portions 218*al* to 218*pl* and 218*ar* to 218*pr* is substantially the same as that of the first grinding chips 211 and the second grinding chips 212. In the present embodiment, by contriving the way of arranging the thus formed boundary portions 218*al* to 218*pl* and 218*ar* to 218*pr* themselves in the area Ra and the area Rb and making gentle the level difference caused at the boundary portions 218*al* to 218*pl* and 218*ar* to 218*pr*, the level difference transferred and caused on the workpiece W is suppressed.

The boundary portions 218*al* to 218*pl* and 218*ar* to 218*pr* do not necessarily have the mixed composition as described above. That is, in the boundary portions 218*al* to 218*pl* and 218*ar* to 218*pr*, assuming that only the boundary lines between the first grinding chips 211 and the second grinding chips 212 are present, the boundary lines may be designated as the boundary portions 218*al* to 218*pl* and 218*ar* to 218*pr*. The thickness of the boundary portions 218*al* to 218*pl* and 218*ar* to 218*pr* at this time is construed as the thickness of the end portions of the first grinding chips 211 and the second grinding chips 212.

And the first grinding chips 211, 212 and 211 and boundary portions 218*al* to 218*pl* and 218*ar* to 218*pr* formed as described above and having the same thickness are arranged in the above-described order in the axis direction on the outer peripheral surface of the disc-like base 213, whereby the circumferentially-divided grinding chips 2A to 2P are formed.

(Method for Manufacturing the Grinding Wheel 210)

Next, the method for manufacturing the grinding wheel 210 will be described. First, the method for manufacturing the circumferentially-divided grinding chips 2A to 2P will be described. To manufacture the first grinding chips 211, first, powder mixed with the superabrasive grains 214, the binding material 215 and the like is filled with a uniform thickness, for example, onto a lower press mold, having a planar form, of the first grinding chips 211 as shown in FIG. 10. As described previously, the two first grinding chips 211 disposed on both sides in the axial direction of the second grinding chips 212 shown in FIG. 10 are merely vertically reverse to each other and are the same ones when viewed individually.

Thereafter, the powder filled onto the lower press mold is pressed by a first upper mold, whereby a grinding chip material is molded. Then, the press-molded grinding chip material is dried, and after dried, fired to complete the first grinding chips 211 shown in FIG. 11.

Moreover, regarding the second grinding chips 212, like the method for manufacturing the first grinding chips 211, powder mixed with the superabrasive grains 219, the binding material 220 and the like is filled with a uniform thickness, for example, onto a lower press mold, having a planar form, of the second grinding chips 212 as shown in FIG. 10. Thereafter, the powder filled onto the lower press mold is pressed by the first upper mold, whereby a grinding chip material is molded. Then, the press-molded grinding chip material is dried, and after dried, fired to complete the second grinding chips 212 shown in FIG. 11.

The boundary portions 218*al* to 218*pl* and 218*ar* to 218*pr* are manufactured by disposing the first grinding chips 211 and the second grinding chips 212 as shown in FIG. 9 and FIG. 10 and performing firing with the boundary portions being in contact with each other. At this time, the first grinding chips 211 are disposed under a condition where the direction thereof is rotated point-symmetrically with respect to the barycenter C1 at both ends in the axis direction of the second grinding chips 212. Then, at the boundary portions between the fired first grinding chips 211 and second grinding chips 212, the binding material 215 and the binding material 220 are melted. Under such a condition, the superabrasive grains 214 and 219 of the first grinding chips 211 and the second grinding chips 212 are mixed together to form the boundary portions 218*al* to 218*pl* and 218*ar* to 218*pr* (see FIG. 11).

The thus formed circumferentially-divided grinding chips 2A to 2P of the same shape are continuously pasted by an adhesive agent (not shown) to the entire periphery in the circumferential direction of the outer peripheral surface of the disc-like base 213.

(Structure of a Grinder 225)

Figure 12:
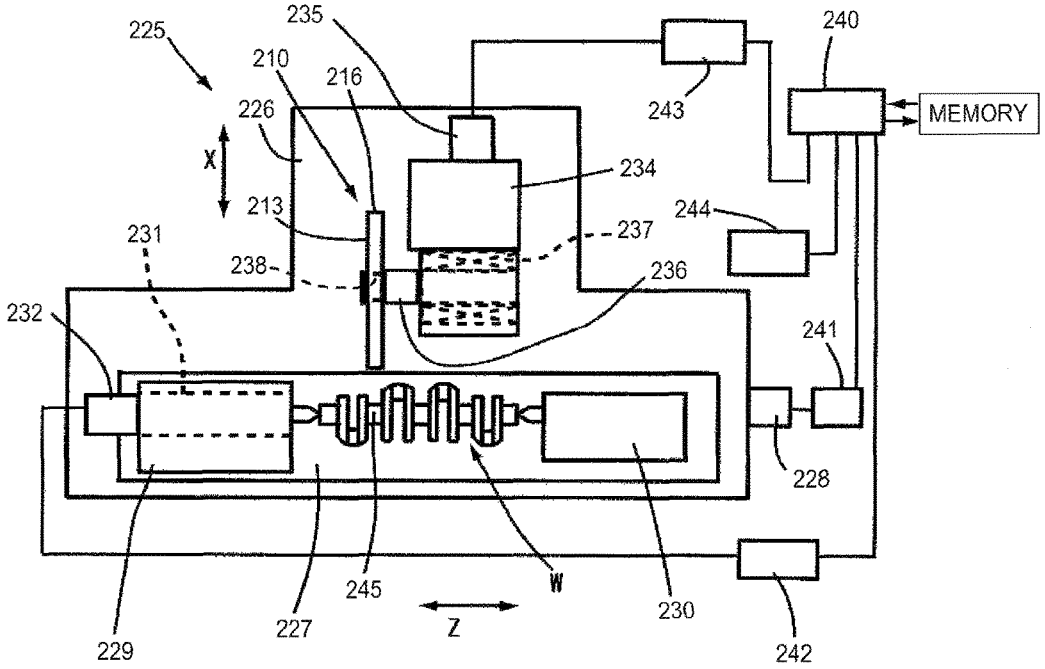
FIG. 12 is a view showing a grinder to which the grinding wheel according to the third embodiment is attached.

Next, the grinder 225 to which the grinding wheel 210 is attached to grind the workpiece W will be described based on FIG. 12. As shown in FIG. 12, on a bed 226, a table 227 is slidably placed and moved in the Z-axis direction through a ball screw by a servo motor 228. On the table 227, a headstock 229 and a tailstock 230 are attached so as to be opposed to each other, and the workpiece W is supported at the center in the Z axis direction between the headstock 229 and the tailstock 230. On the headstock 229, a main shaft 231 is rotatably supported, and rotated by a servo motor 232. The workpiece W is coupled to the main shaft 231 by a lathe dog or the like and rotated.

On the bed 226, a grinding wheel head 234 is slidably placed. The grinding wheel head 234 is moved by a servo motor 235 through a ball screw in the X-axis direction orthogonally intersecting with the Z axis. On the grinding wheel head 234, a grinding wheel spindle 236 is rotatably supported. The grinding wheel spindle 236 is rotated by a built-in motor 237. To the end of the grinding wheel spindle 236, a central hole 238 drilled in the disc-like base 213 of the grinding wheel 210 is fitted. Then, the end of the grinding wheel spindle 236 is fixed by a bolt.

A CNC device 240 is connected to driving circuits 241 to 244 of the servo motors 228, 232 and 235 and the built-in motor 237. The CNC device 240 successively executes NC programs for grinding at the time of grinding to cause the grinding wheel 210 to grind the workpiece W.

(Regarding the Operation of the Grinder)

When causing the grinding wheel 210 to grind the workpiece W, the CNC device 240 executes NC programs for grinding, and outputs a rotation instruction to rotate the grinding wheel 210 at a high rotation speed to the driving circuit 244 of the built-in motor 237. Moreover, the CNC device 240 outputs a rotation instruction to rotate the workpiece W at a circumferential speed suitable for grinding to the driving circuit 242 of the servo motor 232 that rotates the main shaft 231. Then, the CNC device 240 outputs, to the driving circuit 241 of the servo motor 228, a sending instruction to move the table 227 in the Z-axis direction so as to move to a position where the workpiece W is opposed to the grinding wheel 210.

When the grinding wheel 210 is opposed to the part to be ground of the workpiece W, an instruction to advance the grinding wheel head 234 in the X-axis direction at a rough grinding sending speed is outputted to the driving circuit 243 of the servo motor 235. Thereby, the grinding wheel 210 grinds the workpiece W while being supplied with a coolant from a non-illustrated coolant nozzle.

(Operation)

Next, the operation in a case where the workpiece W is ground by the grinding wheel 210 will be described in detail. As mentioned above, the workpiece W is a crank shaft, and the part to be ground is, for example, a crank journal 245 and rotation axis direction side surfaces 246 and 247 of the crank journal shown in FIG. 13 which are a concave portion of the crank shaft (see FIG. 13). Hereinafter, there will be cases where the crank journal 245 and the axis direction side surfaces 246 and 247 are referred to merely as concave portion.

Figure 13:
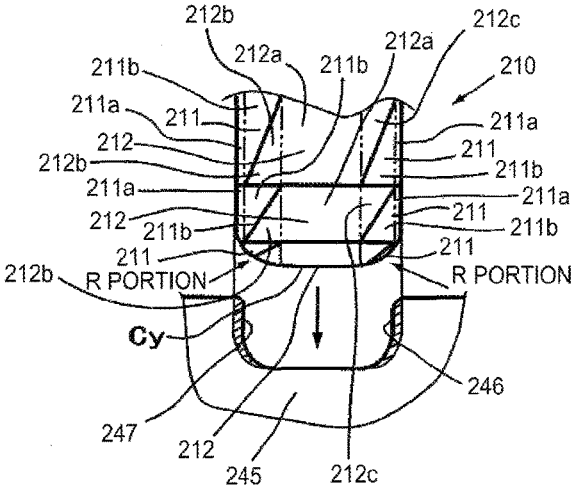
FIG. 13 is a view showing a relation between the grinding wheel according to the third embodiment and the workpiece.

As shown in FIG. 13, the grinding wheel 210 is a form grinding stone, and has a shape slightly larger than the concave portion in the axis direction (Z-axis direction). For this reason, when the grinding wheel 210 cuts into the concave portion, the grinding wheel 210 cuts the side surfaces 246 and 247 (the hatched parts) of the concave portion while removing them by grinding on the side surface portions of the axis direction both end portions (R portions) where the main portions 211*a* of the first grinding chips 211 that are resistant to wear are disposed. In due course, the cylindrical portion Cy of the outer peripheral surface of the grinding wheel 210 reaches the outer peripheral surface of the crank journal 245 which is the bottom surface of the concave portion. Thereby, by the first grinding chips 211, the main portions 212*a* of the second grinding chips 212 that are prone to wear comes into contact with the bottom surface of the concave portion (the outer peripheral surface of the crank journal 245), the bottom surface is ground, thereby performing finishing.

At this time, the R portions between the bottom surface of the concave portion and the side surfaces 246 and 247 of the concave portion are grounded by the extended portions 211*b* of the first grinding chips 211 and the extended portions 212*b* and 212*c* of the second grinding chips 212 provided so as to extend into the areas Ra and Rb in the R portions of the circumferentially-divided grinding chips 2A to 2P.

In this case, in the circumferential direction of the boundary portions 218*al* to 218*pl* and 218*ar* to 218*pr* formed by the boundary portions between the extended portions 211*b* of the first grinding chips 211 and the extended portions 212*b* and 212*c* of the second grinding chips 212, the first grinding chips 211 and the second grinding chips 212 are present in mixture at a predetermined ratio, and the ratio of the mixture differs among the positions in the axis direction. Specifically, in the direction from the second grinding chips 212 toward the first grinding chips 211, at first, the ratio of the second grinding chips 212 is high, the ratio of the first grinding chips 211 gradually increases toward the first grinding chips 211, and in due course, the condition becomes such that only the first grinding chips 211 are present outside the areas Ra and Rb.

For this reason, when the grinding wheel 210 processes the R portions of the concave portion, the size of the wear of the grinding wheel 210 caused in the areas Ra and Rb in the axis direction is intermediate between the wear of the individual first grinding chips 211 and the wear of the individual second grinding chips 212. The intermediate at this time does not mean the center. And in the present embodiment, regarding the size, on the side of the second grinding chips 212, wear is larger by the amount by which the ratio of the mixture of the second grinding chips 212 is higher. Moreover, in the axis direction, since the ratio of the mixture of the first grinding chips 211 increases toward the first grinding chips 211, the grinding wheel 210 is becoming resistant to wear.

At this time, in the planarly developed state of the grinding layer 216, the boundary portions 218*al* to 218*pl* and 218*ar* to 218*pr* are formed by straight lines with a predetermined angle α° with respect to the axis (or the straight line L1) projected onto the plane of the grinding layer 216. Thereby, in the areas Ra and Rb in the axis direction, the level difference between the first grinding chips 211 and the second grinding chips 212 caused due to the wear of the grinding layer 216 also becomes a straight tapered level difference according to the size of the angle α°. That is, the straight tapered level difference caused in the present embodiment can be made gentle compared with the level difference caused when the first grinding chips 211 and the second grinding chips 212 having different properties are disposed in a condition where there is hardly any length of the boundary portions in the axis direction, that is, so that the angle α° is 90 degrees. For this reason, the finishing accuracy of the grounded surface of the workpiece W to which the level difference of the grinding layer 216 is transferred can be made excellent.

Moreover, as shown in FIG. 8B and FIG. 13, the first grinding chips 211 and the boundary portions 218*al* to 218*pl* and 218*ar* to 218*pr* are disposed not on the cylindrical portion Cy formed on the outer peripheral surface of the disc-like base 213 but on parts of the R portions at both ends of the outer peripheral surface. Therefore, even if the boundary portions 218*al* to 218*pl* and 218*ar* to 218*pr* are worn to cause a level difference, the level difference is not transferred to the bottom surface of the concave portion (the outer peripheral surface of the crank journal 245) of the workpiece W grounded by the second grinding chips 212 provided on the cylindrical portion Cy, so that excellent finishing accuracy can be obtained.

<First Modification>

Figure 14:
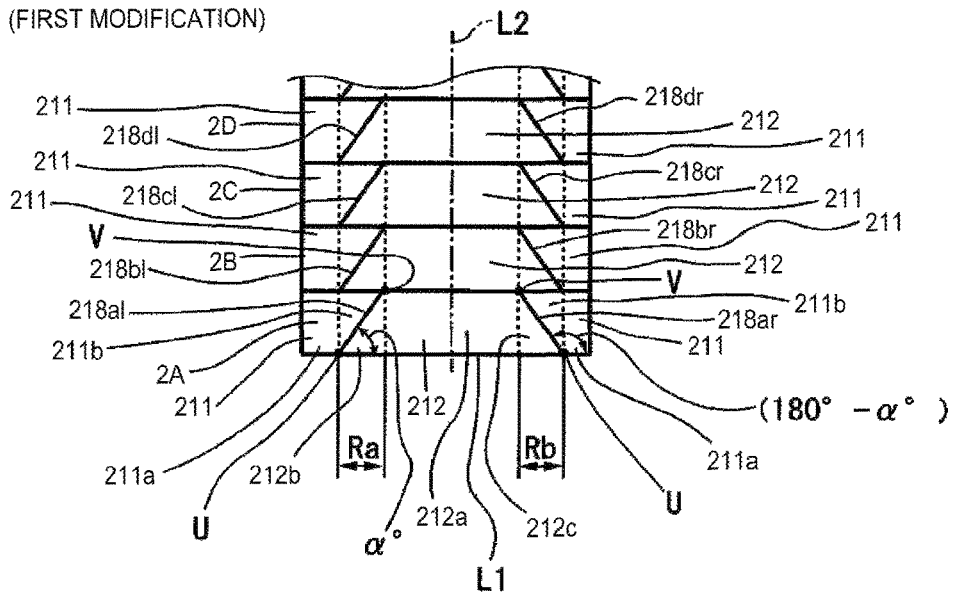
FIG. 14 is a view for explaining a first modification corresponding to the circumferentially-divided grinding chips 2A to 2D of FIG. 9.

In the above-described embodiment, the first grinding chips 211 are formed point-symmetrically with respect to the barycenter C1 of the main portions 212*a* of the second grinding chips 212. Moreover, the boundary portions 218*al* to 218*pl* and 218*ar* to 218*pr* formed on the grinding layer 216 developed into a planar state are both formed from the one end U toward the other end V so as to form the same inclination α° with respect to the axis projected on the grinding layer 216, that is, so as to be parallel to each other. However, the present invention is not limited to this embodiment. As shown in FIG. 14 which is the part corresponding to the S portion of FIG. 9 and its neighborhood, as a first modification, the following may be adopted: The boundary portions 218*al* to 218*pl* and the boundary portions 218*ar* to 218*pr* are linearly symmetrical with respect to a line L2 passing through the barycenter of the main portions 212*a* of the second grinding chips 212 and orthogonal to the axis, and the inclination, from the one end U toward the other end V, corresponding to FIG. 10 of the third embodiment is α° and (180°−α°).

<Second Modification>

Figure 15:
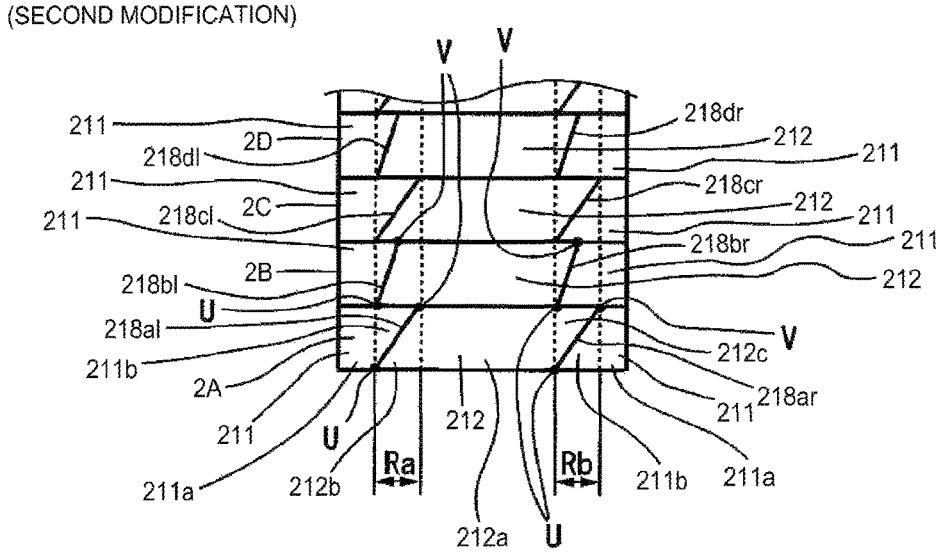
FIG. 15 is a view for explaining a second modification corresponding to the circumferentially-divided grinding chips 2A to 2D of FIG. 9.

Moreover, as a second modification, as shown in FIG. 15 which is the part corresponding to the S portion of FIG. 9 and its neighborhood, the angles α and the shapes of, of the boundary portions 218*al* to 218*pl* and 218*ar* to 218*pr*, the boundary portions adjoining in the circumferential direction may be different instead of being the same. At this time, at the boundary portions 218*al* to 218*pl* and 218*ar* to 218*pr*, not only the angles only between the adjoining boundary portions are different but any angles may be set for any boundary portions 218*al* to 218*pl* and 218*ar* to 218*pr*. That is, the angles of all the boundary portions 218*al* to 218*pl* and 218*ar* to 218*pr* may be different, or the angles may be changed with a predetermined rule. By this, adequate advantages are also obtained.

<Third Modification>

Figure 16:
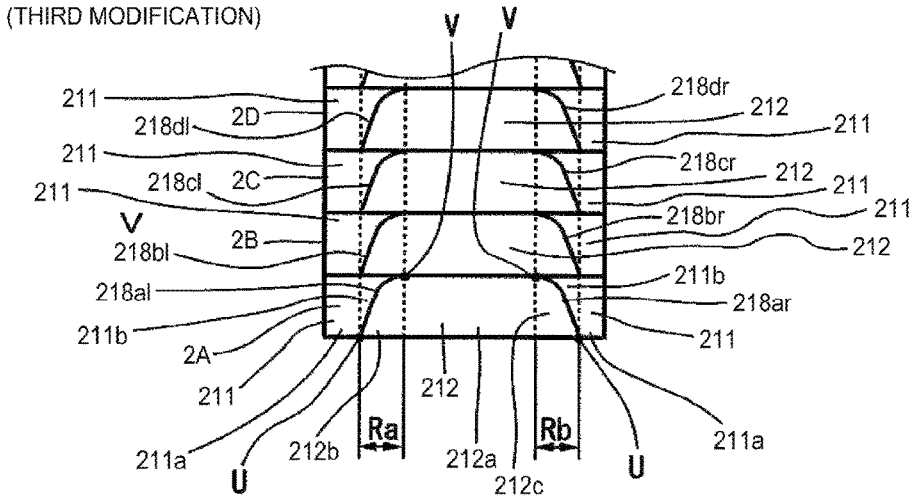
FIG. 16 is a view for explaining a third modification corresponding to the circumferentially-divided grinding chips 2A to 2D of FIG. 9.

Moreover, in the above-described embodiment, the boundary portions 218*al* to 218*pl* and 218*ar* to 218*pr* are straight lines. However, the present invention is not limited to the embodiment. The boundary portions 218*al* to 218*pl* and 218*ar* to 218*pr* may include curved lines as shown in FIG. 16 which is the part corresponding to the S portion of FIG. 9 and its neighborhood.

Fourth Embodiment

Next, a fourth embodiment will be described based on the flowchart of FIG. 17. The fourth embodiment is different from the third embodiment only in the manufacturing method. Therefore, only the difference from the third embodiment will be described and description of the same parts is omitted. In the third embodiment, the shape of the boundary portions 218*al* to 218*pl* and 218*ar* to 218*pr* is preset to manufacture the circumferentially-divided grinding chips 2A to 2P. However, the present invention is not limited to the embodiment; in the fourth embodiment, after the circumferentially-divided grinding chips 2A to 2P are manufactured on a trial basis and evaluated, the circumferentially-divided grinding chips 2A to 2P are manufactured on a formal basis based on the obtained evaluation result. That is, desired circumferentially-divided grinding chips 2A to 2P are manufactured while the result is fed back.

Figure 17:
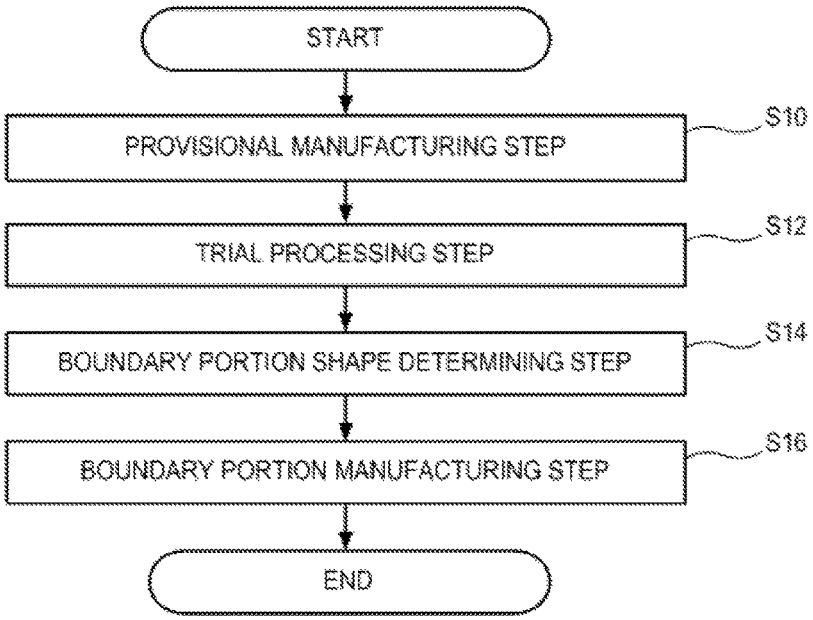
FIG. 17 is a flowchart of a method for manufacturing a grinding wheel according to a fourth embodiment.

As shown in FIG. 17, the grinding wheel manufacturing method in the fourth embodiment is provided with a provisional manufacturing step S10, a trial processing step S12, a boundary portion shape determining step S14, and a boundary portion manufacturing step S16.

At the provisional manufacturing step S10, a provisional grinding layer is formed by the manufacturing method for the above-described third embodiment so that the boundary portions have a predetermined provisional shape, thereby manufacturing a provisional grinding wheel. At this time, the provisional shape of the boundary portions may be any shape. Then, at the trial processing step S12, a trial processing product is ground by the provisional grinding layer of the manufactured provisional grinding wheel.

At the boundary portion shape determining step S14, first, the difference between the size of the trial processing level difference caused on the provisional grinding layer after the processing of the trial processing product and the size of the preset target level difference is checked. Then, the final shape of the boundary portions is determined so that the size of the trial processing level difference is the same as the size of the target level difference. At this time, as the shape of the boundary portions, the shapes described in the third embodiment and the first to third modifications can be selected. Moreover, the level difference in the areas Ra and Rb in the axis direction can be made gentle also by increasing the length (the areas Ra and Rb) of the boundary portions in the axis direction.

At the boundary portion manufacturing step S16, the first and second grinding chips 211 and 212 of each of the plurality of circumferentially-divided grinding chips 2A to 2P are disposed on the outer peripheral surface of the disc-like base 213, and the grinding wheel 210 is manufactured so that the shape of the boundary portions forming the grinding layer 216 is the final shape determined at the boundary portion shape determining step S14. Thereby, a grinding wheel 210 with which a desired level difference can be formed at the time of grinding can be formed.

Fifth Embodiment

Figure 18:
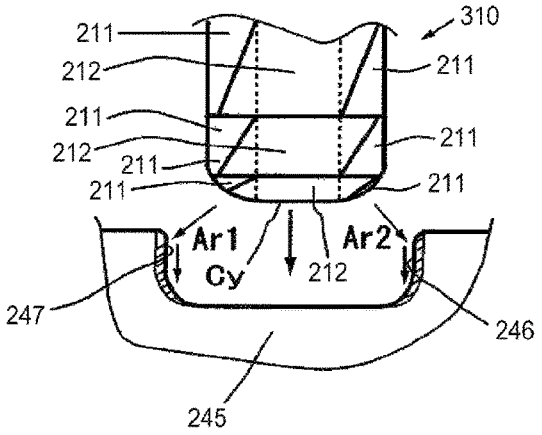
FIG. 18 is a view showing a relation between a grinding wheel according to a fifth embodiment and the workpiece W.

Next, a fifth embodiment will be described. The fifth embodiment is different from the third and fourth embodiments only in the relative size of the grinding wheel to the size of the concave portion which is the object to be ground at the time of grinding. In the third and fourth embodiments, the grinding wheel 210 is a form grinding stone having a cross-sectional shape larger than the concave portion of the outer peripheral surface. However, in the fifth embodiment, a grinding wheel 310 has a size accommodatable in the concave portion as shown in FIG. 18. The structure of the grinding wheel 310 is similar to that of the grinding wheel 210 of the third and fourth embodiments. Therefore, similar elements are denoted by similar reference designations to those in the third and fourth embodiments.

A case where the workpiece W is ground by the grinding wheel 310 will be described. As mentioned above, the workpiece W is the crank shaft, and the object to be ground is the concave portion of the crank shaft. As shown in FIG. 18, the grinding wheel 310 is formed in a size accommodatable in the concave portion in the axis direction. For this reason, the grinding wheel 310 cuts in the directions of the arrow Ar1 and the arrow Ar2 shown in FIG. 18 to remove the axis direction side surfaces 246 and 247 of the concave portion by grinding. That is, the grinding wheel 310 removes the side surfaces 246 and 247 of the concave portion with the side surfaces of the axis direction end portions (R portions) having the first grinding chips 211 that are resistant to wear. Then, when the removal of the side surfaces 246 and 247 is finished, the outer peripheral surface of the grinding wheel 310 reaches the bottom surface of the concave portion (the outer peripheral surface of the crank shaft), and finish grinding of the bottom surface of the concave portion is performed by the cylindrical portion Cy of the outer peripheral surface of the grinding wheel 310 provided with the grinding chips 212 that are prone to wear. Except for the above, all are similar to those of the third and fourth embodiments. By this embodiment, similar advantages to those of the third and fourth embodiments are obtained.

The present invention is not limited to the above-described third to fifth embodiments; it is necessary for the boundary portions 218*al* to 218*pl* and 218*ar* to 218*pr* only to have two points that are different in the axis direction in the line segment between the one end U and the other end V. That is, they may be formed in any shape as long as a displacement component in the axis direction is provided in the line segment. For example, the boundary portions 218*al* to 218*pl* and 218*ar* to 218*pr* may be formed in an S shape from the one end U to the other end V. Moreover, the boundary portions 218*al* to 218*pl* and 218*ar* to 218*pr* may be formed in a U shape having a displacement component in the axis direction from the one end U to be displaced by a predetermined amount in the axis direction and then, returning to the same position as the one end U in a position in the axial direction at the other end V. By these, adequate advantages are also obtained.

(Advantages in the Third to Fifth Embodiments)

According to the above-described embodiments, the grinding wheel 210 is a grinding wheel 210 provided with the disc-like base 213 (the disc-like member) and the grinding layer 216 disposed on the outer peripheral surface of the disc-like base 213. The grinding layer 216 is provided with the plurality of circumferentially-divided grinding chips 2A to 2P divided in the circumferential direction of the disc-like base 213. The circumferentially-divided grinding chips 2A to 2P are formed by arranging the first grinding chips 211 and the second grinding chips 212 having different properties in the axis direction, and the shape of the boundary portions 218*al* to 218*pl* and 218*ar* to 218*pr* between the first grinding chips 211 and the second grinding chips 212 is a shape connecting positions that are different in the axis direction.

According to the above-described embodiment, in the areas Ra and Rb in the axis direction where the boundary portions 218*al* to 218*pl* and 218*ar* to 218*pr* of the circumferentially-divided grinding chips 2A to 2P are present, the first grinding chips 211 and the second grinding chips 212 are present in mixture at a predetermined ratio, and when viewed in the axis direction of the grinding wheel 210, the ratio of the mixture is changed. For this reason, when the grinding wheel 210 processes the workpiece W, the size of the wear caused in the areas Ra and Rb of the boundary portions 218*al* to 218*pl* and 218*ar* to 218*pr* in the axis direction is a size between the size of the wear caused on the individual first grinding chips 211 and the size of the wear caused on the individual second grinding chips 212. Thereby, in the present embodiment product, in the areas Ra and Rb of the boundary portions 218*al* to 218*pl* and 218*ar* to 218*pr* in the axis direction, the level difference caused between the first grinding chips 211 and the second grinding chips 212 is gentle compared with the level difference caused when the first grinding chips 211 and the second grinding chips 212 are arranged under a condition where there is hardly any width of the boundary portions in the axial direction, so that the finishing accuracy of the workpiece W is excellent.

Moreover, according to the above-described third embodiment, the shapes of all the boundary portions 218*al* to 218*pl* and 218*ar* to 218*pr* of the plurality of circumferentially-divided grinding chips 2A to 2P are the same. Thereby, the first grinding chips 211, two of which are used by each of the circumferentially-divided grinding chips 2A to 2P, can all be common members, which contributes to reduced cost.

Moreover, according to the first to third modifications of the above-described third embodiment, the shapes of the boundary portions 218*al* to 218*pl* and 218*ar* to 218*pr* of the plurality of circumferentially-divided grinding chips 2A to 2P are different. Thereby, the shape of the level difference caused on the boundary portions 218*al* to 218*pl* and 218*ar* to 218*pr* can be easily adjusted to a desired shape.

Moreover, according to the above-described embodiments, the boundary portions 218*al* to 218*pl* and 218*ar* to 218*pr* of the plurality of circumferentially-divided grinding chips 2A to 2P are continuously connected from the one end U toward the other end V in the axis direction of the boundary portions 218*al* to 218*pl* and 218*ar* to 218*pr*. Thereby, the level difference caused on the boundary portions 218*al* to 218*pl* and 218*ar* to 218*pr* can be made gentle over the entire width of the boundary portions.

Moreover, according to the above-described embodiments, the shape of the boundary portions 218*al* to 218*pl* and 218*ar* to 218*pr* of the plurality of circumferentially-divided grinding chips 2A to 2P is formed by the same inclination α° with respect to the axis direction. Thereby, the boundary portions 218*al* to 218*pl* and 218*ar* to 218*pr* are easily formed, and by the action of the boundary portions 218*al* to 218*pl* and 218*ar* to 218*pr*, the level difference caused in the areas Ra and Rb of the grinding layer 216 is formed by a tapered plane surface having a predetermined angle.

Moreover, according to the method for manufacturing the grinding wheel 210 of the above-described embodiments, by arranging the first and second grinding chips 211 and 212 of the plurality of circumferentially-divided grinding chips 2A to 2P on the outer peripheral surface of the disc-like base 213 (the disc-like member), the grinding layer 216 provided with the boundary portions 218*al* to 218*pl* and 218*ar* to 218*pr* of the above-described embodiments is formed. As described above, by a simple manufacturing method, the above-described grinding wheel 210 is obtained where the degree of the level difference caused on the outer peripheral surface of the disc-like base 213 (the disc-like member) is adjusted.

Moreover, according to the method for manufacturing the grinding wheel 210 of the above-described embodiments, the provisional manufacturing step S10 is provided where the provisional grinding layer is formed by the manufacturing method for the above-described embodiments so that the boundary portions 218*al* to 218*pl* and 218*ar* to 218*pr* have a predetermined provisional shape. Moreover, the trial processing step S12 is provided where the trial processing product is processed by the provisional grinding layer. Moreover, the boundary portion shape determining step S14 is provided where the difference between the size of the trial processing level difference caused on the provisional grinding layer after the processing of the trial processing product and the size of the preset target level difference is checked and the final shape of the boundary portions 218*al* to 218*pl* and 218*ar* to 218*pr* is determined so that the size of the trial processing level difference is the same as the size of the target level difference. Further, the boundary portion manufacturing step S16 is provided where thereafter, in order that the shape of the boundary portions 218*al* to 218*pl* and 218*ar* to 218*pr* is the determined final shape, the first and second grinding chips 211 and 212 of each of the plurality of circumferentially-divided grinding chips 2A to 2P are disposed on the outer peripheral surface of the disc-like base 213 (disc-like member) to form the grinding layer 216. Thereby, a desired level difference shape can be always obtained for the grinding layer 216, so that control can be easily performed so that the shape of the level difference transferred to the cylinder outer peripheral surface of the workpiece W is small.

According to the method for manufacturing the grinding wheel 210 of the above-described embodiments, the sixteen (plurality of) already formed circumferentially-divided grinding chips 2A to 2P are disposed on the outer peripheral surface of the disc-like base 213 (disc-like member) to thereby form the grinding layer 216. However, the present invention is not limited to this manufacturing method; the grinding wheel 210 may be manufactured by separately pasting the first and second grinding chips 211 and 212 constituting the circumferentially-divided grinding chips 2A to 2P to the outer peripheral surface without the circumferentially-divided grinding chips 2A to 2P being previously formed.

Moreover, while sixteen circumferentially-divided grinding chips (2A to 2P) are arranged in the circumferential direction in the above-described embodiment, the number may be larger or may be smaller.

Moreover, in the above-described embodiment, as shown in FIG. 8B, the boundary portions 218*al* to 218*pl* and 218*ar* to 218*pr* formed between the first and second grinding chips 211 and 212 are provided on parts of the R portions at both ends of the grinding layer 216. However, the present invention is not limited to this embodiment. The boundary portions 218*al* to 218*pl* and 218*ar* to 218*pr* may be partly provided on the cylindrical portion Cy. By this, adequate advantages are also obtained.

Moreover, in the above-described embodiments, for the workpiece W made of one kind of material, the grinding wheels 210 and 310 are structured by combining the two kinds of first and second grinding chips 211 and 212 according to the shape parts having different grinding resistances. However, the present invention is not limited to the embodiments; for a workpiece where a plurality of kinds of materials are joined together, a grinding wheel may be structured by combining grinding chips according to the materials. By this, similar advantages to those of the above-described embodiments are obtained.

The present application is based upon Japanese Patent Application (Patent Application No. 2014-222200) filed on Oct. 31, 2014 and Japanese Patent Application (Patent Application No. 2015-026043) filed on Feb. 13, 2015, the contents of which are incorporated herein by reference.

DESCRIPTION OF REFERENCE SIGNS

10, 110, 210, 310: Grinding wheel; 11, 211: first grinding chip; 12, 212: second grinding chip; 13, 213: disc-like base (disc-like member); 14, 19, 214, 219: superabrasive grain (abrasive grain); 15, 215: vitrified binding material; 16, 216: grinding layer; 18*a* to 18*p*: mixture portion; 20, 220: resinoid binding material; 25, 225: grinder; A to P, 2A to 2P; circumferentially-divided grinding chip; W: workpiece; 211*a*: main portion; 211*b*: extended portion; 212*b*, 212*c*: extended portion; 218*a* to 218*p*: boundary portion; Ra, Rb: area; S10; provisional manufacturing step; S12: processing step; S14: boundary portion shape determining step; S16: boundary portion manufacturing step.

The invention claimed is:

1. A grinding wheel comprising:

a disc-like member; and a grinding layer disposed on an outer peripheral surface of the disc-like member, wherein the grinding layer comprises a plurality of circumferentially-divided grinding chips which are divided in a circumferential direction of the disc-like member, wherein each of the circumferentially-divided grinding chips is formed by arranging a first grinding chip and a second grinding chip in an axis direction of the grinding wheel, the first grinding chip and the second grinding chip having different properties, and wherein a shape of a boundary portion between the first grinding chip and the second grinding chip is a shape which has a displacement component in the axis direction and which connects different positions in the axis direction, and both of the first grinding chip and the second grinding chip are provided in a range in which the boundary portion exists in the axis direction.

2. The grinding wheel according to claim 1, wherein the shapes of all of the boundary portions of the plurality of circumferentially-divided grinding chips are the same.

3. The grinding wheel according to claim 1, wherein the shapes of the boundary portions of the plurality of circumferentially-divided grinding chips are different.

4. The grinding wheel according to claim 1, wherein the shape of each of the boundary portions of the plurality of circumferentially-divided grinding chips is a shape which is continuously connected from one end toward the other end of the boundary portion in the axis direction.

5. The grinding wheel according to claim 4, wherein the shape of each of the boundary portions of the plurality of circumferentially-divided grinding chips is formed by a same inclination with respect to the axis direction.

6. A method for manufacturing a grinding wheel, wherein the grinding wheel is the grinding wheel according to claim 1, the method for manufacturing the grinding wheel, comprising:

forming the grinding layer by arranging the first and second grinding chips provided in each of the plurality of circumferentially-divided grinding chips on the outer peripheral surface of the disc-like member.

7. The method for manufacturing the grinding wheel according to claim 6, comprising:

forming a provisional grinding layer by the manufacturing method according to claim 6 to manufacture a provisional grinding wheel such that the boundary portions have predetermined provisional shapes;

processing a trial processing product by the provisional grinding layer;

checking a difference between a size of a trial processing level difference caused on the provisional grinding layer after processing of the trial processing product and a size of a preset target level difference, and determining final shapes of the boundary portions such that the size of the trial processing level difference is the same as the size of the target level difference; and disposing the first and second grinding chips of each of the plurality of circumferentially-divided grinding chips on the outer peripheral surface of the disc-like member to form the grinding layer such that the boundary portions have the determined final shapes.

8. A grinding wheel comprising:

a disc-like member; and a grinding layer disposed on an outer peripheral surface of the disc-like member, wherein the grinding layer comprises a plurality of circumferentially-divided grinding chips divided in a circumferential direction, wherein each of the plurality of circumferentially-divided grinding chips is formed by arranging a first grinding chip and a second grinding chip in an axis direction, the first grinding chip and the second grinding chip having different properties, wherein a boundary portion between the first grinding chip and the second grinding chip of each of the plurality of circumferentially-divided grinding chips is defined as an axis direction boundary portion, wherein the axis direction boundary portions of at least three of the plurality of circumferentially-divided grinding chips continuously arranged in the circumferential direction are arranged toward a predetermined direction in the axis direction in an order of the at least three circumferentially-divided grinding chips continuously arranged in the circumferential direction, and wherein each of the boundary portions has a predetermined width in the axis direction, and in the predetermined width, the abrasive grains of the first and second grinding chips having different properties disposed at both ends of the boundary portions in the axis direction are present in mixture to form a mixture portion.

9. The grinding wheel according to claim 8, wherein the first grinding chip is large in a grain diameter of an abrasive grain and high in hardness, wherein the second grinding chip is small in the grain diameter of the abrasive grain and low in hardness, wherein the first grinding chip is disposed on each end portion of the grinding layer in the axis direction, and the second grinding chip is disposed in a central portion of the grinding layer in the axis direction.

10. The grinding wheel according to claim 9, wherein the grinding layer comprises a cylindrical portion and an R portion disposed at each end of the cylindrical portion, wherein the first grinding chip is disposed on a part of each of the R portions, wherein the second grinding chip is disposed on the cylindrical portion and a remaining part of each of the R portions, and wherein the axis direction boundary portion is disposed on a part of each of the R portions.

11. The grinding wheel according to claim 8, wherein an amount of overlap in the axis direction of the mixture portion with a mixture portion adjoining in the circumferential direction on the outer peripheral surface of the disc-like member changes.

12. A method for manufacturing a grinding wheel, wherein the grinding wheel is the grinding wheel according to claim 8, and the method for manufacturing the grinding wheel, comprising:

forming the grinding layer by arranging the first and second grinding chips provided in each of the plurality of circumferentially-divided grinding chips on the outer peripheral surface of the disc-like member.

* * * * *